US007337824B2

(12) United States Patent
Berger

(10) Patent No.: US 7,337,824 B2
(45) Date of Patent: Mar. 4, 2008

(54) MAGNETIC TILT AND RAISE/LOWER MECHANISMS FOR A VENETIAN BLIND

(75) Inventor: David Barry Berger, Willowdale (CA)

(73) Assignee: Masonite International Corporation, Mississauga (CA)

( * ) Notice: Subject to any disclaimer, the term of this patent is extended or adjusted under 35 U.S.C. 154(b) by 278 days.

(21) Appl. No.: 10/784,131

(22) Filed: Feb. 19, 2004

(65) Prior Publication Data

US 2004/0226665 A1 Nov. 18, 2004

Related U.S. Application Data

(60) Provisional application No. 60/447,688, filed on Feb. 19, 2003, provisional application No. 60/466,057, filed on Apr. 29, 2003.

(51) Int. Cl.
*E06B 3/32* (2006.01)

(52) U.S. Cl. ..... 160/107

(58) Field of Classification Search ..... 160/168.1 R, 160/176.1 R, 107, 170, 171, 173 R, 177 R, 160/178.1 R
See application file for complete search history.

(56) References Cited

U.S. PATENT DOCUMENTS 2,389,956 A * 11/1945 Castilonia ..... 160/172 R
3,129,471 A 4/1964 Johnson et al.
3,201,832 A 8/1965 Hordis et al.
3,253,644 A 5/1966 Gotoh et al.
3,722,572 A 3/1973 Hall
4,480,674 A 11/1984 Anderson
4,588,012 A 5/1986 Anderson
4,611,648 A 9/1986 Anderson
4,684,911 A 8/1987 Streeter
4,685,502 A 8/1987 Spangenberg
4,702,296 A 10/1987 Anderson
4,723,586 A 2/1988 Spangenberg
4,768,576 A 9/1988 Anderson
4,817,698 A * 4/1989 Rossini et al. ..... 160/107
5,396,944 A 3/1995 Rossini
5,699,845 A 12/1997 Jelic (Continued)

FOREIGN PATENT DOCUMENTS

EP 0082723 A1 8/1982

(Continued)

*Primary Examiner*—Blair M. Johnson
(74) *Attorney, Agent, or Firm*—Berenato, White & Stavish

(57) ABSTRACT

Magnetic tilt and raise/lower mechanisms for a venetian blind disposed between the glass panes of a multi-pane window are disclosed. The magnetic mechanisms act on tilt lines and a raise/lower line coupled to the venetian blind. An inner follower carriage is magnetically coupled to an external carriage moveable over one of the glass panes. Movement of the external carriage imparts movement of the follower carriage, which in turn actuates the tilt or raise/lower lines, causing the venetian blind to move. The inner follower carriage and the external carriage include at least one magnet assembly mounted on at least one wheel set to facilitate movement of the carriages over the glass panes as well as to reduce the force required to raise or lower the venetian blind. A multiplier is employed to reduce the stroke length required to raise or lower the venetian blind. Further, a clutch coupling an external slider to the external carriage is provided and to disconnect the slider from the external carriage upon the application of a force exceeding a threshold level.

55 Claims, 19 Drawing Sheets

U.S. PATENT DOCUMENTS

| | | | | |
|---|---|---|---|---|
| 5,718,274 | A | 2/1998 | Streeter | |
| 5,769,142 | A | 6/1998 | Nicolosi | |
| RE35,926 | E | 10/1998 | Hagen | |
| 5,826,638 | A | 10/1998 | Jelic | |
| 6,059,006 | A | 5/2000 | Rossini | |
| 6,065,524 | A | 5/2000 | Rossini | |
| 6,095,223 | A | 8/2000 | Rossini et al. | |
| 6,272,811 | B1 | 8/2001 | Hagen | |
| 6,332,491 | B1 | 12/2001 | Rossini | |
| 6,401,790 | B1 | 6/2002 | Dai et al. | |
| 6,601,633 | B2 * | 8/2003 | Sun et al. | 160/107 |
| 6,932,139 | B2 * | 8/2005 | Early et al. | 160/107 |
| 2003/0173036 | A1 * | 9/2003 | Kwon et al. | 160/107 |
| 2004/0211528 | A1 * | 10/2004 | Jin et al. | 160/107 |

FOREIGN PATENT DOCUMENTS

| | | |
|---|---|---|
| JP | 07/091153 | 4/1995 |
| JP | 08-013957 | 1/1996 |
| JP | 8086167 | 4/1996 |
| JP | 8165867 | 6/1996 |
| WO | WO 01/27431 | 4/2001 |

* cited by examiner

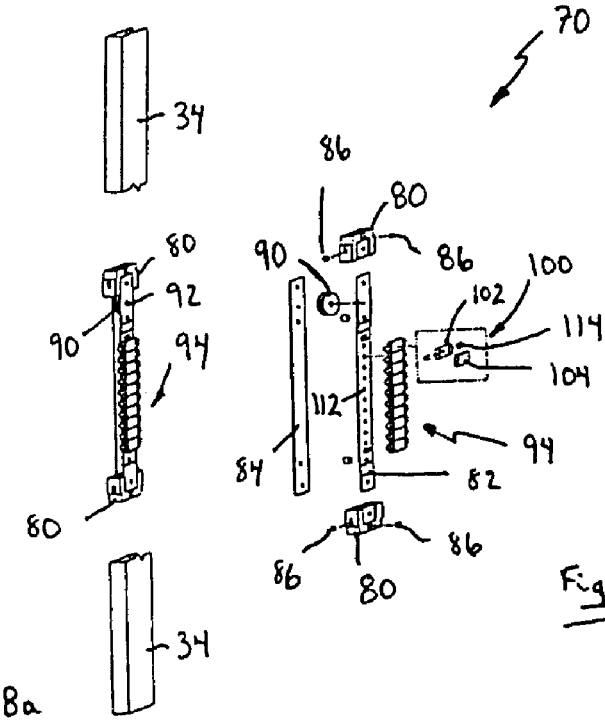
Fig. 8a
Fig. 8b
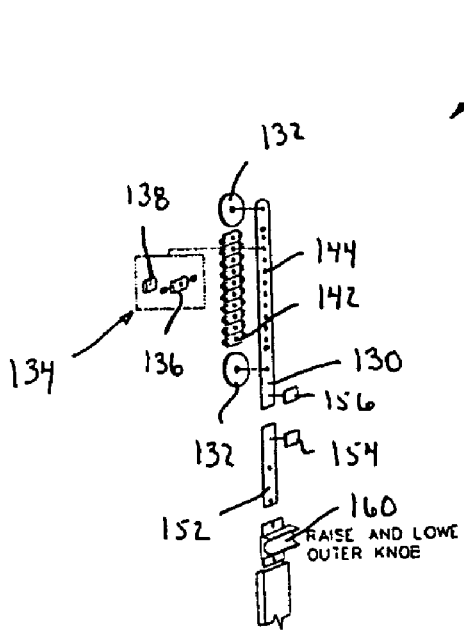
Fig. 9

MAGNETIC TILT AND RAISE/LOWER MECHANISMS FOR A VENETIAN BLIND

CROSS-REFERENCE TO RELATED APPLICATIONS

This application claims the benefit of U.S. Provisional Patent Application No. 60/447,688 filed on Feb. 19, 2003 and the benefit of U.S. Provisional Patent Application No. 60/466,057 filed on Apr. 29, 2003, both of which are incorporated herein by reference.

FIELD OF THE INVENTION

The present invention relates generally to venetian blinds and in particular to magnetic tilt and raise/lower mechanisms for a venetian blind and to multi-pane windows incorporating the same.

BACKGROUND OF THE INVENTION

Venetian blinds within double-glazed or multi-pane windows that include raise/lower and/or tilt mechanisms are known in the art. Venetian blinds of this nature typically include external magnets that are magnetically coupled to tilt and/or lift carriages disposed between the glass panes. The external magnets run along the exterior surface of the glass panes to move the tilt and/or lift carriages as a result of the magnetic coupling therebetween. Movement of the tilt carriage moves the tilt lines of the venetian blind causing the slats of the venetian blind to tilt and thereby open or close the venetian blind. Movement of the lift carriage moves the raise/lower line of the venetian blind causing the venetian blind to raise or lower. Many different tilt and/or lift mechanisms for these types of venetian blinds have been considered.

For example, U.S. Pat. No. 4,817,698 to Rossini et al. discloses a raise and lower mechanism for a venetian blind disposed between a pair of glass planes. The raise and lower mechanism includes an internal magnet located between the glass panes and an external magnet for moving the internal magnet. Cables for lifting and lowering the venetian blind extend over a pulley and are coupled to a slider that is secured to the internal magnet. The stroke of the slider is equal to the maximum extension of the venetian blind. A counterweight is provided to balance the increasing weight on the cables as the venetian blind is raised. A tilt mechanism for the venetian blind is also provided and includes an internal magnet that is located between the glass panes and an external magnet for moving the internal magnet. A helical shaft extends the length of the venetian blind and is coupled to a second shaft via an angular return transmission. The second shaft is coupled to a tilt ladder. Linear movement of the internal magnet rotates the helical shaft, which in turn imparts rotation of the second shaft. Rotation of second shaft rotates the tilt ladder causing the venetian blind to open or close.

U.S. Pat. No. Re 35,926 to Hagen discloses a raise and lower mechanism for a venetian blind disposed between two panes of glass. The raise and lower mechanism includes an external magnet that is magnetically coupled to an internal magnet positioned between the glass panes. Rotational movement of the external magnet causes the internal magnet to move. Movement of the internal magnet causes the venetian blind to raise or lower.

Japanese Patent Document No. 07-091153 to Yasushi et al. discloses a mechanism for raising and lowering a venetian blind disposed between a pair of glass panes. The raising and lowering mechanism includes a first magnet pair coupled to a shaft. The shaft is rotatable in response to movement of the first magnet pair. A second magnet pair that is magnetically coupled to the first magnet pair is disposed within an external lifting-lowering member. Linear movement of the external lifting-lowering member moves the first magnet pair to rotate the shaft. Rotation of the shaft winds or unwinds a cord thereby to raise or lower the venetian blind.

European Patent Application No. 082 723 to Anderson et al. discloses a tilting transfer mechanism for a venetian blind assembly disposed between the glass panes of a double glazing unit. The tilting transfer mechanism comprises an internal magnet located between the glass panes and an external magnet for moving the internal magnet. The internal magnet is coupled to hanger members, which support the slats of the venetian blind. Linear up and down movement of the internal magnet causes the hanger members to pivot and tilt the slats of the venetian blind thereby to open or close the venetian blind.

U.S. Pat. No. 4,685,502 to Spangenberg discloses a tilting mechanism for a venetian blind disposed between the glass panes of a double-glazed window assembly. The tilting mechanism comprises an internal magnet located between the panes and an external magnet for moving the internal magnet. Linear movement of the internal magnet imparts rotational movement of upper and lower horizontal support members via a drive element. Rotation of the upper and lower support members causes the slats of the venetian blind to tilt thereby to open or close the venetian blind.

U.S. Pat. No. 5,826,638 to Jelic discloses a tilt mechanism for a venetian blind disposed between the glass panes of a double-glazed window. The tilt mechanism comprises an internal magnet located between the glass panes and an external magnet for moving the internal magnet. The internal magnet is coupled to a tilt assembly. The tilt assembly includes a shaft that extends across the width of the venetian blind. The shaft is coupled to a tilt ladder, which supports the slats of the venetian blind. Specifically, the internal magnet is coupled to a nut that is mounted on a threaded rod. Linear movement of the nut in response to movement of the internal magnet causes the threaded rod to rotate, which in turn imparts rotation of the shaft thereby to open or close the venetian blind.

U.S. Pat. No. 6,401,790 to Dai et al. discloses a tilt mechanism for a venetian blind comprising a first magnet located between the glass panes of a double-glazed window and an external second magnet magnetically coupled to the first magnet. The first magnet is also coupled to a pulley system. Movement of the first magnet in response to movement of the external second magnet actuates a tilt ladder causing the venetian blind to open or close.

Japanese Patent Document No. 08-086167 to Takayuki et al. discloses a mechanism for operating a venetian blind disposed between the glass panes of a double-glazed window. The mechanism includes an internal magnet that is coupled by a cord to a shaft extending across the width of the venetian blind. An external magnet, which is located outside of the glass panes, is magnetically coupled to the internal magnet. A dial is provided for rotating the external magnet. Rotation of the dial and hence the external magnet, moves the internal magnet. Movement of the internal magnet actuates the cord to cause the shaft to rotate. Rotation of the shaft actuates a tilt ladder causing the venetian blind to open or close.

Japanese Patent Document No. 08-013957 to Takeshi et al. discloses a mechanism for tilting a venetian blind that is located between the glass panes of a double-glazed window. A rotatable disc is located outside of the glass panes and is coupled to a shaft via magnets. Rotation of the disc rotates the shaft. Rotation of the shaft actuates a tilt ladder causing the venetian blind to open or close.

As will be appreciated, although the double-glazed windows disclosed in the above-identified references include internal tilt and/or lift mechanisms making use of external magnets running over glass panes to actuate the internal tilt and/or lift mechanisms, problems exist. Since the external magnets are abrasive, movement of the external magnets over the glass panes often results in scratching and marking of the glass panes after extended use making the windows aesthetically unappealing.

In addition, a significant amount of force is required to overcome the coefficient of static friction between the external magnets and the glass panes when it is desired to actuate the internal tilt and/or lift mechanisms. This can result in an operator applying excessive forces to the external magnets, which may break the magnetic couple between the external magnets and the internal tilt and/or lift mechanisms. In the case of lift mechanisms, if the external magnets become magnetically de-coupled from the lift mechanisms when the venetian blind is in a fully or partially raised condition, the venetian blind may free fall to a lowered condition. This may potentially damage the venetian blind. Also, if the external magnets become magnetically de-coupled from the internal tilt and/or lift mechanisms, the glass panes may be damaged when the magnet couple between the external magnets and the internal tilt and/or lift mechanism is re-established. Moreover, since the external magnets and the tilt and/or lift mechanisms are usually concealed, re-establishing the magnetic couple between the external magnets and the tilt and/or lift mechanisms can prove to be difficult.

In the case of lift mechanisms, the pull ratio of the lift mechanisms is typically one-to-one. Thus, for every inch the venetian blinds are to be raised, the external magnets must be moved along the glass panes an equal distance. In the case of large multi-pane windows that accommodate correspondingly large venetian blinds, reaching and moving the external magnets the required distances to raise the venetian blinds to fully open conditions can be difficult, especially for elderly people, children, short people or people with back problems. As will be appreciated, improvements in magnetically actuatable mechanisms to raise/lower and/or tilt a venetian blind disposed between the glass panes of a multi-pane window are desired.

It is therefore an object of the present invention to provide novel magnetic tilt and raise/lower mechanisms for a venetian blind and novel multi-pane windows incorporating the same.

SUMMARY OF THE INVENTION

According to an aspect of the present invention, there is provided a multi-pane window having a magnetic mechanism for actuating a venetian blind disposed between the glass panes thereof, the magnetic mechanism comprising: an inner follower carriage disposed between the glass panes and operable to actuate said venetian blind when moved; an external carriage disposed outside the glass panes and magnetically coupled to said inner follower carriage, said external carriage being moveable thereby to move said inner follower carriage; and at least one friction reducing element to facilitate movement of at least one of said carriages over the glass panes.

According to another aspect of the present invention, there is provided a multi-pane window having a magnetic raise/lower mechanism for raising and lowering a venetian blind disposed between the glass panes thereof, the magnetic raise/lower mechanism comprising: a raise/lower line coupled to the venetian blind; an inner follower carriage disposed between the glass panes and operable to actuate said raise/lower line thereby to move said venetian blind; an external carriage disposed outside said glass panes and magnetically coupled to said inner follower carriage, said external carriage being moveable to move said inner follower carriage and actuate the raise/lower line; and a multiplier acting on the raise/lower line to increase the pull ratio of said magnetic raise/lower mechanism.

According to yet another aspect of the present invention there is provided a multi-pane window having a magnetic raise/lower mechanism for raising and lowering a venetian blind disposed between the glass panes thereof, the magnetic raise/lower mechanism comprising: a raise/lower line coupled to the venetian blind; an inner follower carriage disposed between the glass panes and operable to actuate said raise/lower line thereby to move said venetian blind; an external carriage disposed outside the glass panes and magnetically coupled to said inner follower carriage, said external carriage being moveable to move said inner follower carriage and actuate the raise/lower line; an external slider coupled to said external carriage and operable to move said external carriage when said external slider is moved; and a clutch acting between said external carriage and said external slider and operable to decouple said external carriage from said external slider when a force exceeding a threshold level is applied to said external slider to inhibit said external carriage and said inner follower carriage from magnetically decoupling.

According to still yet another aspect of the present invention, there is provided a multi-pane window having a magnetic raise/lower mechanism for raising and lowering a venetian blind disposed between the glass panes thereof, comprising: a raise/lower line coupled to the venetian blind; an inner follower carriage disposed in a tubular housing between the glass panes and operable to actuate said raise/lower line thereby to move said venetian blind; an external carriage disposed outside the glass panes and magnetically coupled to said inner follower carriage, said external carriage being moveable to move said inner follower carriage and actuate said raise/lower line; and an accumulator disposed above said inner follower assembly and encompassing said raise/lower line to gather slack accumulating in said raise/lower line.

The present invention provides advantages in that since the inner magnet assemblies and/or external magnet assemblies include friction reducing elements such as for example wheel sets, to facilitate movement of the magnet assemblies over the glass pane, the coefficient of friction between the magnet assemblies and the glass panes is significantly reduced. Sliding resistance can also be reduced by using structured sliding surfaces on the inner and external carriages, and/or on the surface of the glass panes. Additionally and/or alternatively, anti-friction surfaces can be provided on the surface of the glass panes to reduce sliding resistance.

Reducing resistance makes operating the venetian blind very easy. By reducing the coefficient of friction between the magnet assemblies, the likelihood of the glass pane being marked by the magnet assemblies due to wear is also reduced. Further, pull force and mechanical response is maintained.

The present invention provides further advantages in that since the magnet assemblies are coupled to the inner and external carriages by magnetism only, i.e. floating couples, the magnet assemblies of the inner and external carriages remain aligned and in close proximity to the glass panes even if the glass panes are not perfectly planar. This helps to ensure a consistent magnetic couple between the inner and external carriages.

The present invention provides yet further advantages in that since the raise/lower mechanism may include a multiplier, the pull ratio of the raise/lower mechanism can be increased to a ratio that is greater than one-to-one. This of course facilitates raising and lowering of the venetian blind. In addition, since the raise/lower mechanism may include a clutch that releases when excessive forces are applied to the external carriage, de-coupling of the inner and external carriages that may result in the venetian blind free falling to a fully lowered condition is avoided.

Another advantage of the present invention is that, through the use of an accumulator, slack in the raise/lower line is gathered thereby avoiding tangling.

BRIEF DESCRIPTION OF THE DRAWINGS

Embodiments of the present invention will now be described more fully with reference to the accompanying drawings in which:

FIGS. 8*a* and 8*b* are perspective and exploded perspective views of the inner carriage and guide assembly of FIG. 3;

FIG. 9 is an exploded perspective view of the outer carriage assembly of FIG. 4;

DETAILED DESCRIPTION OF THE INVENTION

Figure 1:
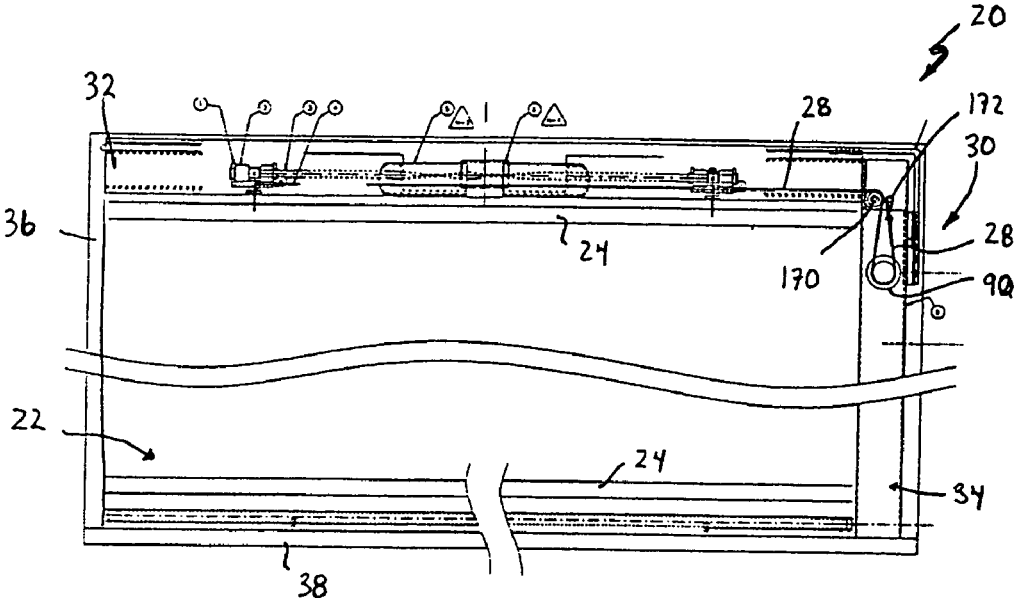
FIG. 1 is a front elevation view, partly in section, of a multi-pane window including a venetian blind having magnetic tilt and raise/lower mechanisms.
Figure 2:
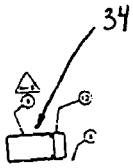
FIG. 2 is a top plan view of a housing forming part of the magnetic raise/lower mechanism of FIG. 1.
Figure 3:
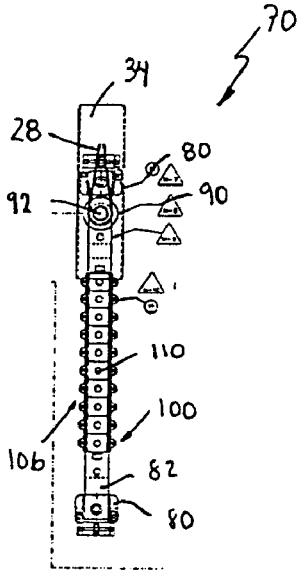
FIG. 3 is a front elevation view of an inner carriage and guide assembly including a multiplier forming part of the magnetic raise/lower mechanism of FIG. 1.
Figure 4:
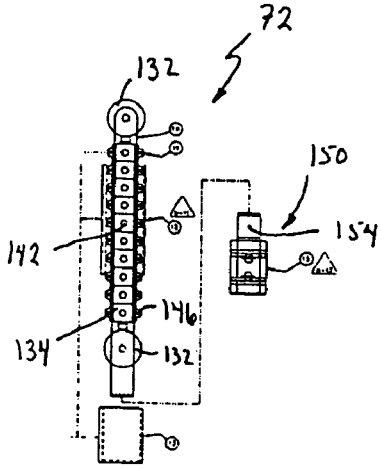
FIG. 4 is a front elevation view of an outer carriage assembly forming part of the magnetic raise/lower mechanism of FIG. 1.
Figure 5:
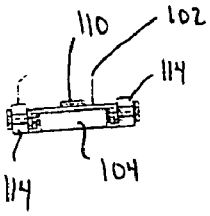
FIG. 5 is a side elevation view of a magnet assembly forming part of the inner carriage and guide assembly of FIG. 3.
Figure 6:
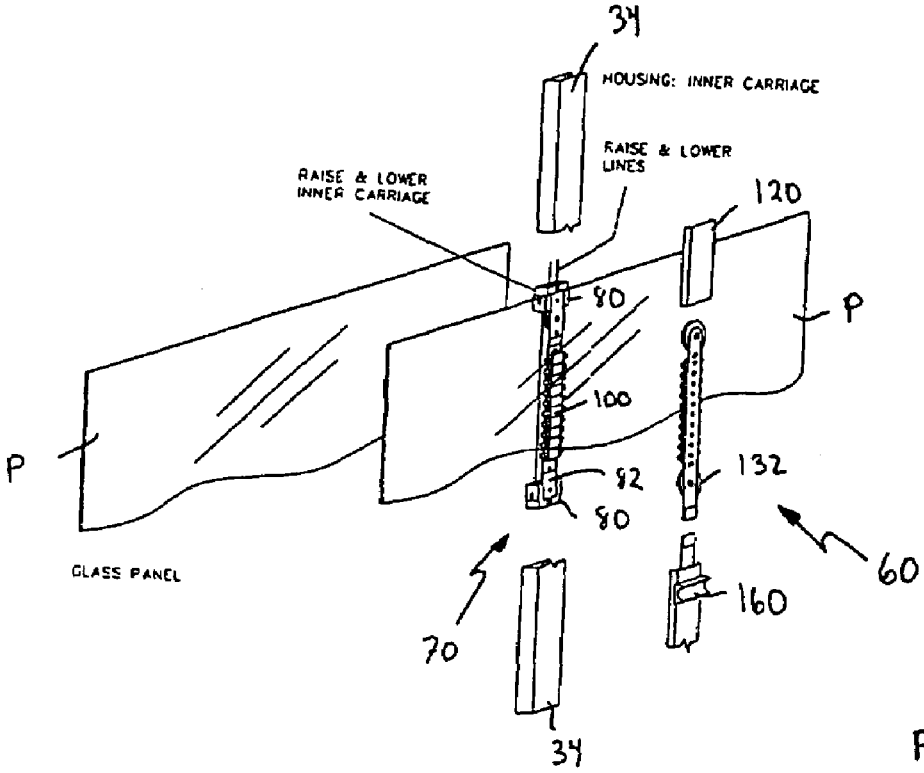
FIG. 6 is a perspective view showing the inner carriage and guide assembly of FIG. 3 and the outer carriage assembly of FIG. 4.
Figure 10:
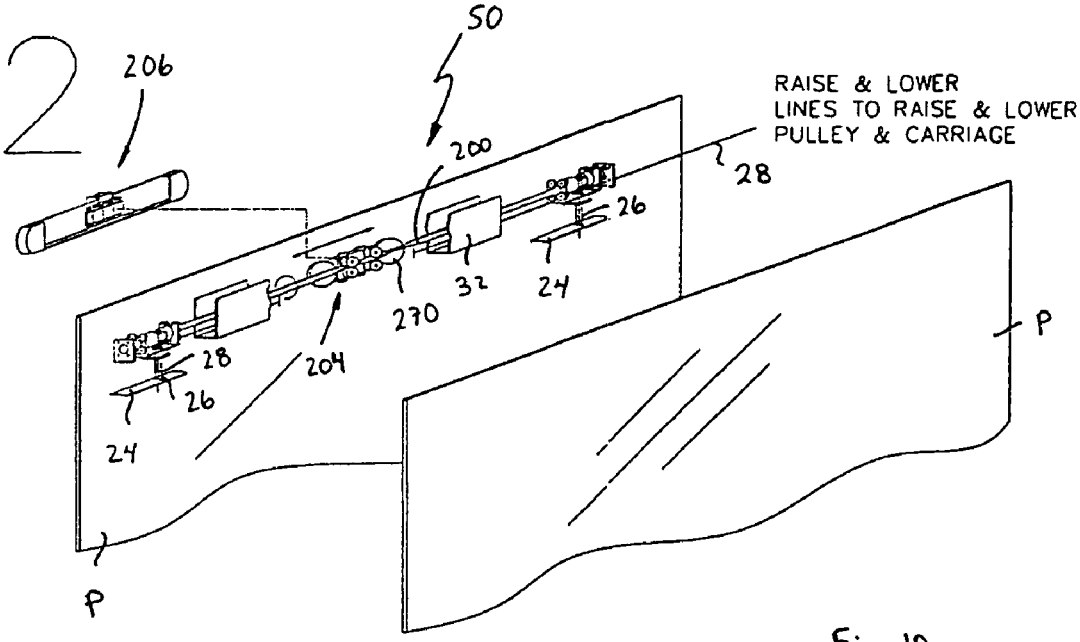
FIG. 10 is a perspective view of the magnetic tilt mechanism of FIG. 1.
Figure 11:
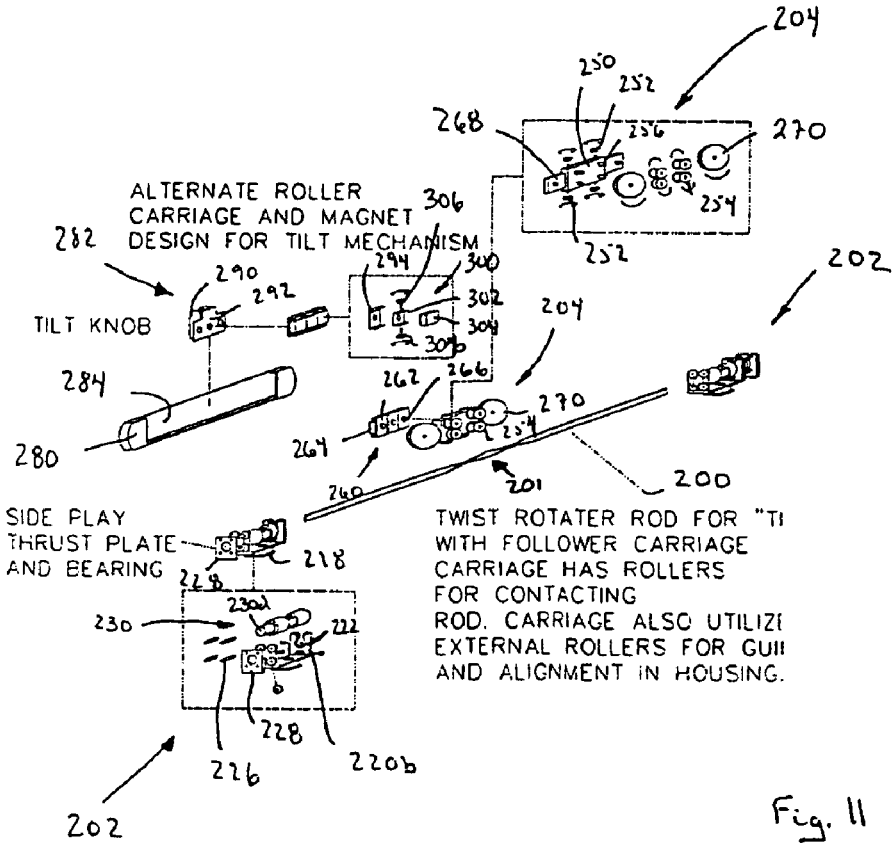
FIG. 11 is an exploded perspective view of the magnetic tilt mechanism of FIG. 10.
Figure 12A:
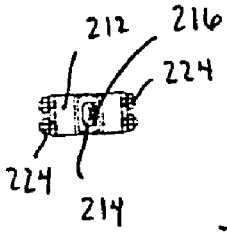
FIGS. 12*a* and 12*b* are top plan and side elevation views of a cradle forming part of the magnetic tilt mechanism of FIG. 10.
Figure 12B:
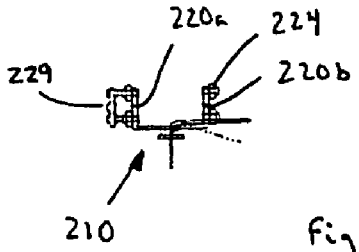
Figure 13A:
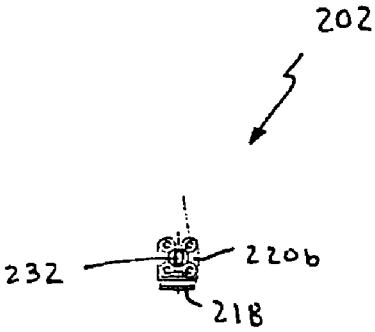
FIGS. 13*a* and 13*b* are end and side elevation views of a cradle assembly including the cradle of FIGS. 12*a* and 12*b;*
Figure 13B:
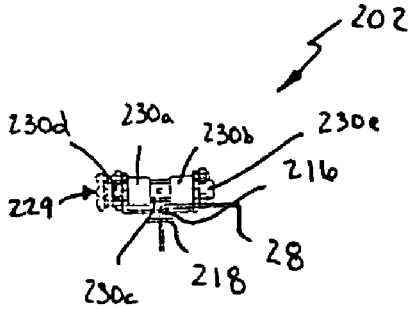

Turning now to FIGS. 1, 6 and 10, a multi-pane window is shown and is generally identified by reference numeral 20. Multi-pane window 20 in this embodiment is a double-glazed window including a pair of spaced glass panes P. A venetian blind 22 including a plurality of slats 24 is disposed between the glass panes P. Tilt lines 26 and a raise/lower line 28 interconnect the slats 24. The tilt lines 26 enable the slats 24 to be tilted thereby to open or close the venetian blind 22.

The raise/lower line 28 enables the venetian blind 22 to be raised or lowered within the window 20.

The glass panes P are surrounded by a frame assembly 30. Frame assembly 30 includes an upper tilt mechanism housing 32, a tubular side raise/lower mechanism housing 34, a side rail 36 and a bottom rail 38. In this embodiment, housing 32 comprises an extruded PVC front portion and an aluminum rear portion. Housing 34 is entirely constructed of aluminum. Aluminum is used as it does not generally deform with changes in humidity and heat to which windows are typically subjected. Those skilled in the art will of course appreciate that other suitable materials can be used to form the housings 32 and 34.

A magnetic tilt mechanism 50 is disposed within the housing 32 and is coupled to the tilt lines 26. A magnetic raise/lower mechanism 60 is disposed within the housing 34 and is coupled to the raise/lower line 28. As a result, actuation of the tilt and raise/lower mechanisms 50 and 60 allows the venetian blind 22 to be tilted open or closed and/or to be raised or lowered.

FIGS. 1 to 9 better illustrate the raise/lower mechanism 60. The raise/lower mechanism 60 includes an inner follower carriage and guide assembly 70 disposed within the housing 34 and an external carriage assembly 72 moveable over one of the glass panes P in line with and along the housing 34. The inner follower carriage and guide assembly 70 and the external carriage assembly 72 are magnetically coupled by a strong magnetic force. In this manner, linear movement of the external carriage assembly 72 along the glass pane P over the housing 34 causes the inner follower carriage and guide assembly 70 to follow the external carriage assembly 72 and travel linearly within the housing 34.

The inner follower carriage and guide assembly 70 includes a pair of vertically spaced hollow bearing housings 80 formed of nylon or other suitable material. The bearing housings 80 are joined by a chassis comprising a pair of laterally spaced, elongate metal inner and outer support plates 84 and 82, respectively. Opposite sides of each bearing housing 80 accommodate a bearing 86. The bearings 86 contact the interior surfaces of the housing 34 to guide the inner follower carriage and guide assembly 70 as it travels linearly within the housing 34. A pulley 90 is disposed between the inner and outer support plates 84 and 82 adjacent the upper bearing housing 80 and is mounted on an axle 92 extending between the inner and outer support plates 84 and 82.

A series 94 of side-by-side magnet assemblies 100 is magnetically coupled to the outer support plate 82. Each magnet assembly 100 includes a metal U-shaped carriage 102 housing a magnet 104 and at least one rolling mobilizer mounted on the carriage 102. In this embodiment, the rolling mobilizer is a wheel set 106. The bight of each carriage 102 has a protrusion 110 formed thereon that is received by a corresponding dimple 112 formed in the outer support plate 82. The co-operating protrusions and dimples maintain the magnet assemblies 100 in position while providing a floating couple for the magnet assemblies 100. Each wheel set 106 includes a pair of wheels 114 with each wheel being mounted on a different arm of the carriage 102. The wheels 114 are formed of plastic such as, for example, Nylatron®. The wheels 114 facilitate linear movement of the inner follower carriage and guide assembly 70 as it travels within the housing 34.

The external carriage assembly 72 is disposed within a housing 120 positioned on the glass pane P. The external carriage assembly 72 includes an elongate metal support plate 130 having upper and lower guide wheels 132 rotatably mounted thereon adjacent its opposite ends. A series of side-by-side magnet assemblies 134 is magnetically coupled to the support plate 130. The magnetic assemblies 134 are similar to the magnet assemblies 100. Each magnet assembly 134 includes a metal U-shaped carriage 136 housing a magnet 138 and at least one rolling mobilizer, which in this embodiment is a wheel set 140 mounted on the carriage 136. The bight of each carriage 136 has a protrusion 142 formed thereon that is received by a corresponding dimple 144 formed in the support plate 130. The co-operating protrusions and dimples maintain the magnet assemblies 134 in position while providing a floating couple for the magnet assemblies 134. Each wheel set 140 includes a pair of wheels 146 with each wheel being mounted on a different arm of the carriage 136. The wheels 146 are also formed of plastic or other suitable material. The wheels 146 facilitate linear movement of the external carriage assembly 72 as it travels within the housing 120 over the glass pane P.

Figure 7:
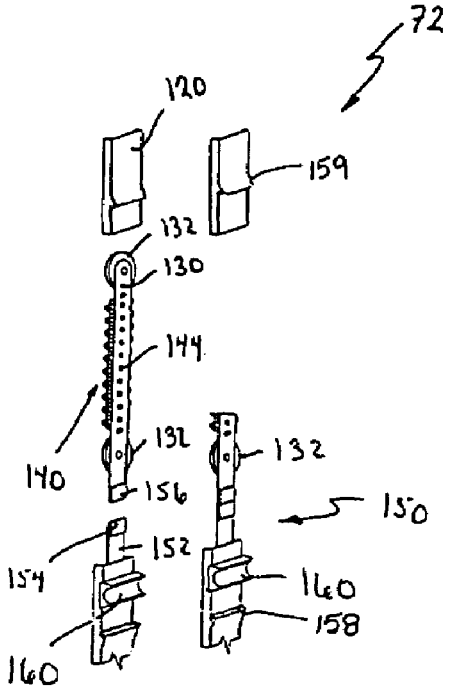
FIG. 7 is a perspective view of the outer carriage assembly showing its clutch in a disengaged and engaged condition.

A clutch 150 is magnetically coupled to the external carriage assembly 72. As can be seen, the clutch 150 includes an elongate metal latch plate 152 having a magnet 154 secured thereto adjacent its upper end. The magnet 154 is associated with a magnet 156 secured to the support plate 130 adjacent its lower end. The latch plate 152 is fastened to an external slider 160 that is slidable along the outer surface of the housing 120. Slider 160 is connected to the latch plate 152 via a U-shaped connector (not shown), the bridging portion of which travels through a slot (not shown) provided in the right side of the housing 120. Movement of the slider 160 along the housing 120 is limited by lower and upper stops 158 and 159 respectively. The latch plate 152 extends into the housing 120 sufficiently so that the magnets 154 and 156 abut and magnetically couple as shown in FIG. 7 thereby to secure releasably the clutch 150 to the outer carriage assembly 72.

A raise/lower line pulley 170 and a raise/lower termination post 172 are disposed within the housing 34 adjacent the top right-hand corner of the multi-pane window 20. The raise/lower line 28 extending from the venetian blind 22 travels around the pulley 170 and passes through the upper bearing housing 80. The raise/lower line 28 then travels around the pulley 90 and back up through the upper bearing housing 80 before being secured to the termination post 172. The roller 170, pulley 90 and termination post 172 form a multiplier to increase the pull ratio of the raise/lower mechanism 60.

During operation, when it is desired to raise or lower the venetian blind 22, the slider 160 is grasped and slid in the desired direction along the housing 120 pulling the clutch 154 with it. As the slider 160 slides, the magnetic couple between the clutch magnets 154 and 156 causes the external carriage assembly 72 to move with the clutch 150. During movement of the external carriage assembly 72, the wheels 146 of the magnet assemblies 134 facilitate the linear movement of the external carriage assembly 72 along the glass pane P. Since the magnet assemblies 134 are aligned with and magnetically coupled to the magnet assemblies 100 of the inner follower carriage and guide assembly 70, the inner follower carriage and guide assembly 70 is pulled with the external carriage assembly 72 as it moves. The bearings 86 on the bearing housings 80 and the wheels 114 on the magnet assemblies 100 facilitate movement of the inner follower carriage and guide assembly 70 within the housing 34. Linear movement of the inner follower carriage and guide assembly 70 causes the pulley 90 to move relative to the pulley 170 and termination post 172. If the inner follower carriage and guide assembly 70 is moved downwardly so that the pulley 90 moves away from the pulley 170 and termination post 172, the venetian blind 22 is raised. If the inner follower carriage and guide assembly 70 is moved upwardly so that the pulley 90 moves towards the pulley 170 and termination post 172, the venetian blind 22 is lowered.

The floating couple between the magnet assemblies 100 and outer support plate 82 and between the magnet assemblies 134 and the support plate 134 allow the magnet assemblies to remain aligned while accommodating surface variations. As a result, the integrity of the magnetic couple between the inner follower carriage and guide assembly 70 and the external carriage assembly 72 is maintained.

As mentioned above, the pulley 170, pulley 90 and termination post 172 arrangement act as a multiplier so that less movement of the external carriage assembly 72 is required to raise or lower the venetian blind 22. In this particular example since the pulley 170 and termination post 172 are positioned adjacent one another, the multiplier has a doubling effect so that one inch of movement of the external carriage assembly 72 and, hence, one inch of movement of the inner follower carriage and guide assembly 70, raises or lowers the venetian blind 22 by two inches.

The magnetic attraction force between the magnets 154 and 156 of the clutch 150 is selected to be less that the magnetic attraction forces between the magnet assemblies 100 and 134. In this manner, if a force is applied to the slider 160 that is greater than the magnetic attraction forces between the magnet assemblies 100 and 134, the magnetic attraction forces between the magnets 154 and 156 will break before the magnetic attraction forces between the magnetic assemblies 100 and 134 can be broken. This helps to prevent the external carriage assembly 72 from being magnetically de-coupled from the inner follower carriage and guide assembly 70, in the event of a sudden pull on the slider 160, which as mentioned previously, can result in the venetian blind 22 free falling to a fully lowered position within the window 20.

Turning now to FIGS. 1 and 10 to 13*b*, the magnetic tilt mechanism 50 is better illustrated. Magnetic tilt mechanism 50 includes a spiral actuator rod 200 extending along the housing 32. The ends of the spiral actuator rod 200 are received by cradle assemblies 202 that permit the actuator rod 200 to rotate. A follower carriage 204 is mounted on the actuator rod 200 and is moveable therealong. Spiral actuator rod 200 is constructed of a non-magnetic material, such as stainless steel, plastic or carbon fiber, in order to reduce frictional resistance induced by magnetic attraction between the follower carriage 204 and the spiral actuator rod 200. The spiral actuator rod 200 includes a helically twisted central portion 201. An external tilt carriage 206 is aligned with and magnetically coupled to the follower carriage 204.

Each cradle assembly 202 includes a frame 210 having a base 212. An opening 214 is provided through the base 212 at its center. A pulley 216 is mounted on the base 212 adjacent the opening 214. The raise/lower line 28 is wound around the pulleys 216. The base 212 sits on a tubular pedestal 218 positioned below the opening 214. A pair of upstanding side plates 220*a* and 220*b* is positioned at opposite ends of the base 212. Each side plate 220 has a passage 222 provided therethrough and supports a plurality of bearings 224 arranged to provide a channel therebetween. Pins 226 extend from the bearings 224 on side plate 220*a* and are received by holes provided in a stop comprising a side play thrust plate 228 having a ball bearing 229. The side play thrust plate 228 inhibits axial movement of the spiral actuator rod 200. A spool 230 is rotatably supported by the bearings 224 of the cradle assembly 202. The spool 230 includes a pair of horizontally spaced larger diameter sections 230*a* and 230*b* separating inner and outer smaller diameter sections 230*c*, 230*d* and 230*e* respectively. The small outer diameter sections 230*d* and 230*e* are received by the passages in the side plates 220*a* and 220*b* and are supported by the bearings 224. The tilt lines 26 pass through the pedestal 218 and opening 214. A recess 232 is provided in one end of the spool 230 and is shaped to receive one end of the spiral actuator rod 200.

The follower carriage 204 includes a rectangular metal chassis 250 having wheels 252 at its corners that contact the interior surfaces of the housing 32. Similar to the raise/lower mechanism, the wheels 252 are formed of a plastic, such as Nylatron or other suitable material. The wheels 252 facilitate linear movement of the follower carriage 204 as it travels within the housing 32. A plurality of formed and profiled rollers 254, in this case four rollers, are mounted on the rear of the chassis 250 via posts 256. The profiled rollers 254 have running surfaces designed to firmly contact the spiral actuator rod 200 to oppose rotation of the actuator rod 200 relative to the profiled rollers 254, while at the same time maintaining low friction rolling contact between the running surfaces of the profiled rollers 254 and the spiral actuator rod 200. A plurality of side-by-side magnet assemblies 260 is magnetically coupled to the front of the chassis 250. The magnet assemblies 260 are somewhat similar to the magnet assemblies 100 and 134. Each magnet assembly 260 includes a metal U-shaped carriage 262 housing a magnet 264 that is magnetically coupled to the carriage 262. The bight of each carriage 262 has a protrusion 266 formed thereon that is received by a corresponding dimple (not shown) formed in the chassis 250. The co-operating protrusions and dimples maintain the magnet assemblies 260 in position while providing a floating couple for the magnet assemblies 260. Rectangular support plates 268 extend from opposite ends of the chassis 250. Each support plate 268 rotatably supports a guide roller 270. The guide rollers 270 contact the top and bottom surfaces of the housing 32 to guide the follower carriage 204 as it travels linearly within the housing 32.

The external tilt carriage 206 includes a slide housing 280 that is aligned with the actuator rod 200. The slide housing is 280 secured to the front of the glass pane P and accommodates a tilt knob assembly 282. The tilt knob assembly 282 is moveable linearly along the slide housing 280. The slide housing 280 has a slide channel 284 formed in its rear surface. The tilt knob assembly 282 includes an external slider 290, a support plate 292 spaced from the slider 290 and a web joining the support plate 292 and the slider 290. The space between the slider 290 and the support plate 292 accommodates the slide housing 280 to position the support plate 292 in the slide channel 284. A plurality of U-shaped channels 294 is secured to the support plate 292. The bights of the channels 294 have dimples formed therein.

A plurality of side-by-side magnet assemblies 300 is magnetically coupled to the support plate 292. The magnet assemblies 300 are aligned with and magnetically coupled to the magnet assemblies 260. Each magnet assembly 300 includes a metal U-shaped carriage 302 housing a magnet 304 and having a wheel set thereon. The bight of the carriage 302 has a protrusion thereon that is received by the dimple formed in an associated channel 294. The protrusions and dimples maintain the magnet assemblies 300 in position while providing a floating couple for the magnet assemblies 300. Each wheel set includes a pair of wheels 306 with each wheel being mounted on a different shaft of the carriage 302.

The wheels 306 are also formed of plastic or some other suitable material. The wheels 306 facilitate linear movement of the tilt knob assembly 282 as it travels over the glass pane P along the slide channel 284.

During operation, when it is desired to tilt the slats 24 of the venetian blind 22 to open or close the venetian blind, the slider 290 is grasped and the tilt knob assembly 282 is slid along the slide channel 284 in the desired direction. As the tilt knob assembly 282 slides and the support plate 292 moves linearly along the slide channel 284, the magnet assemblies 300 travel with the support plate 292. The wheels 306 of the magnet assemblies 300 facilitate this linear movement and reduce wear on the glass pane P. Since the magnet assemblies 300 are magnetically coupled to the magnet assemblies 260, the follower carriage 204 is pulled linearly with the tilt knob assembly 282. The wheels 252 and guide rollers 270 facilitate movement of the follower cartridge 204 within the housing 32. Linear movement of the follower carriage 204, and thus the profiled rollers 254 over the helically twisted central portion 201, causes the spiral actuator rod 200 to rotate. The bearings 224 and spools 230 allow for free and smooth rotation of the actuator rod. During linear movement of the follower carriage 204, the profiled rollers 254 apply axial forces to the helically twisted central portion 201 of the spiral actuator rod 200. Intimate abutment of the spools 230 fitted on the ends of the spiral actuator rod 200 with the bearings 229 of the thrust plates 228 effectively serves to inhibit axial movement of the spiral actuator rod 200. The bearings 229 also reduce rotational friction between the spools 230 and the thrust plates 228 that results from the axial forces.

As the spiral actuator rod 200 rotates, the spools 230 fitted on the ends of the spiral actuator rod 200 rotate. Depending on the direction of motion of the slider 290, and thus the direction of rotation of the spiral actuator rod 200, the spools 230 either pay in or pay out the tilt lines 26 pinned to the spools 230 causing the slats 24 of the venetian blind 22 to tilt and thereby either open or close the venetian blind 22.

As will be appreciated, the magnetic tilt and raise/lower mechanisms reduce friction, drag and wear due to the use of external and inner carriages that carry friction reducing elements, which in the above-described embodiment are rolling mobilizers. The floating couples associated with the magnetic assemblies maintain the integrity of the magnet coupling between the external and internal carriages. As a result, pull force and mechanical response is maintained at a high level.

If the housings 120 and/or 280 are secured to the glass pane P with adhesive, there is a possibility for a flexible but secure joint between the housings and the glass pane P. Such a joint allows the housings to displace slightly with respect to the glass pane P yet remain firmly fixed to the glass pane to accommodate imperfections in the glass pane, housings and carriages.

Although the wheels of the magnet assemblies have been described as being formed of plastic or other suitable materials, combinations of materials may be used. For example, the wheels of the magnet assemblies can be formed of dual material i.e. the perimeters of the wheels can be formed of rubber with the remainder of the wheels formed of steel. In this case, the rubber flexes under loads allowing the centers of the wheels to contact the glass pane and offer shock resistance to breakage of the glass pane if the magnet assemblies slip and jump. This can happen if a sudden pull force is applied to the external carriages.

If desired, the wheels 114, 146, 252 and 306, upper and lower guide wheels 132, guide rollers 270, pulley 170, pulley 90 and profiled rollers 254 can all be mounted on precision ball bearings to decrease the rotational friction of these elements and increase their lifetime.

Other suitable means for allowing a floating couple between the chassis of the carriages and the magnet assemblies, such as holes, can be used in place of the dimples.

Figure 14A:
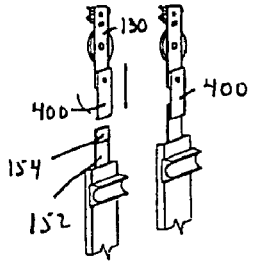
FIGS. 14*a* and 14*b* are perspective views of alternative embodiments of clutches for the outer carriage assembly of FIG. 4.
Figure 14B:
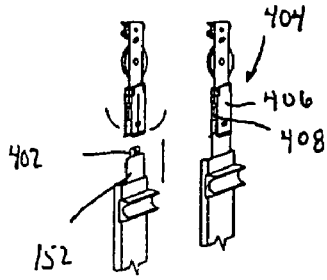

Turning now to FIGS. 14*a* and 14*b*, alternative clutches for use with the external carriage assembly 72 are shown. In FIG. 14*a*, an extension plate 400 is secured to the bottom of the support plate 130. Extension plate 400 includes a small bend that acts to hook onto the outer edge of the magnet 154. When the clutch engages the external carriage assembly 72, the latch plate 152 is positioned behind the extension plate 400 allowing the magnet 154 to magnetically couple to the extension plate 400. As a result, the slider 160, which is physically secured to the latch plate 152, is both magnetically and mechanically coupled to the support plate 130 of the external carriage assembly 72. The greater the bend (up to 100 degrees) and the greater the length of the extended bent portion (up to the thickness of the magnet) of the extension plate 400, the stronger the coupling force. In FIG. 14*b*, the latch plate 152 carries a roller arm 402 having a roller adjacent its distal end rather than a magnet. A clutch element 404 is secured to the bottom of the support plate 130 and receives the roller arm 402. The clutch element 404 includes a pair of arms 406, each of which carries a magnet 408 to bias the arms together thereby to retain the roller arm 402 therebetween. If desired, the magnets can be replaced with small tension springs to bias the arms 406 together.

Figure 15A:
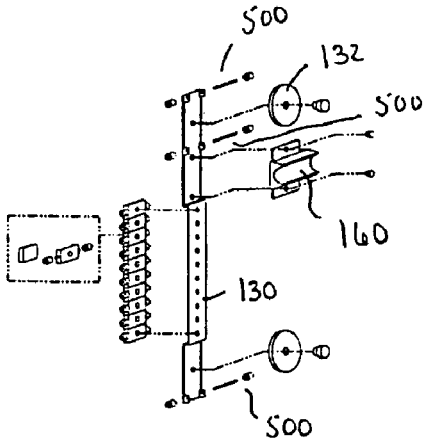
FIGS. 15*a* to 15*c* are exploded and perspective views of an alternative embodiment of an outer carriage assembly.
Figure 15B:
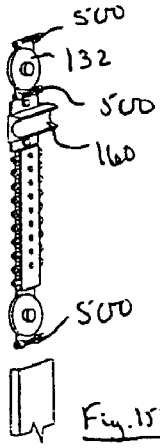
Figure 15C:
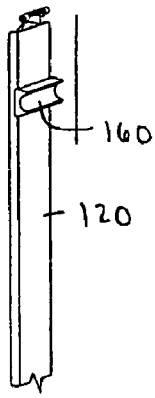

FIGS. 15*a* to 15*c* show an alternative external carriage assembly 72 in various stages of assembly. In this embodiment, the support plate 130 is stepped to define a recess for the magnet assemblies 134. Roller assemblies 500 are provided at opposite ends of the support plate 130 to guide movement of the external carriage assembly 72 along the housing 120.

Figure 16A:
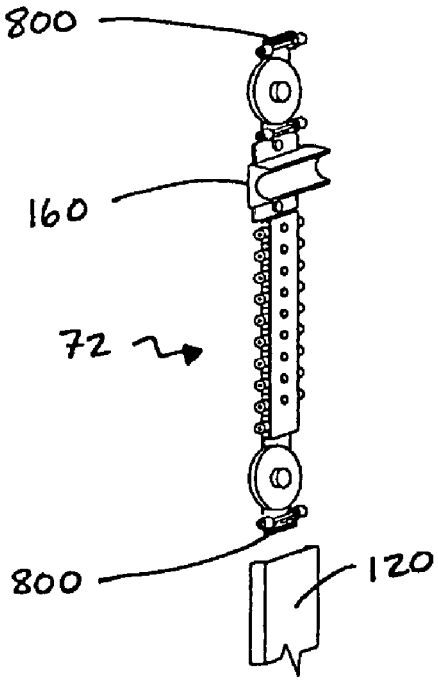
FIG. 16*a* is a perspective view of yet another embodiment of an outer carriage assembly.
Figure 16B:
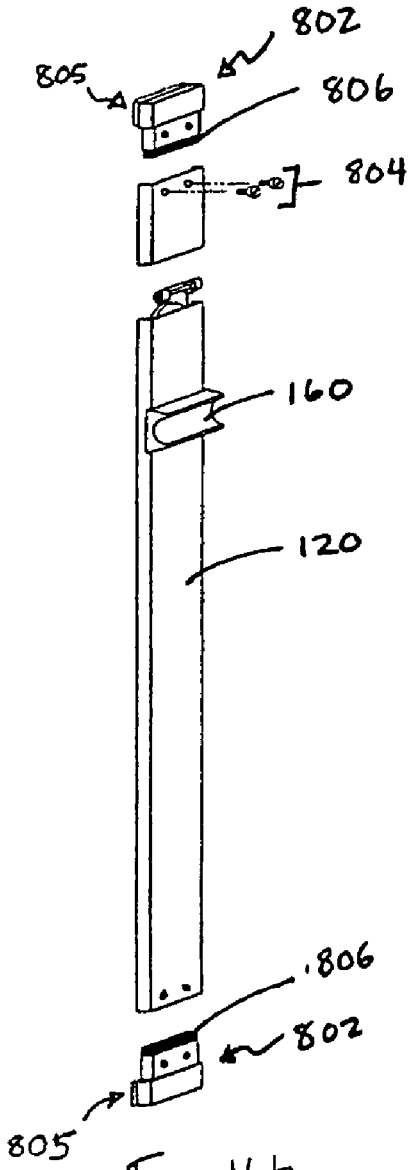
FIG. 16*b* is an exploded perspective view of a housing for the outer carriage assembly of FIG. 16*a;*

FIGS. 16*a* and 16*b* show yet another embodiment of an external carriage assembly 72. The external carriage assembly 72 is similar to that shown in FIGS. 15*a* to 15*c*, however in this embodiment, rubber bumpers 800 are provided at opposite ends of the support plate 130 adjacent the rollers. Also, an intermediate roller is provided between the upper pulley and the point of connection between the slider 160 and the support plate 130. Resilient bumper inserts 806 are integrated into end caps 802 affixed to the ends of the housing 120 by screws 804. The end caps 802 limit travel of the external carriage assembly 72. Affixed to the bottom edge of the end caps 802 are adhesive strips 805. The adhesive strips 805 secure the end caps 802 to the glass pane P and allow the external carriage assembly 72 and the housing 120 to be mounted and mechanically connected to glass pane P.

When the external carriage assembly 72 reaches the upper or lower travel limit, the bumpers 800 of the external carriage assembly 72 abut against the bumpers 806 of the end caps 802 and dampen the impact, thus reducing possible damage to the slider 160, the external carriage assembly 72 and the housing 120. It will be appreciated by those of skill in the art that it may be advantageous under certain circumstances to alternatively fasten the bumpers along the inside the housing 120 at positions other than at its upper and lower ends.

While the bumpers have been described as being provided on the external carriage assembly 72, it will be appreciated that bumpers can also be provided on the tilt mechanism to damper impacts. Also, as an alternative to rubber bumpers, other means to reduce the impact between the carriage assemblies and the housing or elements therein, such as springs or other resilient impact-absorbing materials, can be employed.

Figure 17A:
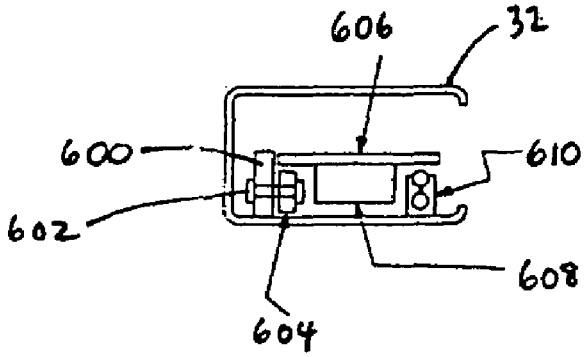
FIGS. 17*a* to 17*d* are front and side sectional views of rolling mechanisms.
Figure 17B:
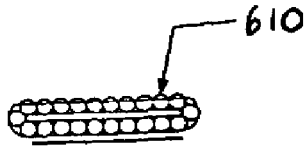

FIGS. 17*a*, 17*b*, 17*c* and 17*d* show alternative magnetic carriage and housing rolling mobilizer assemblies for the inner follower carriage 204 and external tilt carriage 206 of the magnetic tilt mechanism 50. Those of skill in the art will however appreciate that these assemblies are also suitable for use with the inner follower carriage and guide assembly 70 and the external carriage 72 of the raise/lower mechanism 60. In FIG. 17*a*, a rolling mobilizer assembly having two different rolling mobilizer assembly portions are shown. The rolling mobilizers are coupled to the housing and provide a rolling surface for flat carriage undersurfaces. On the left-hand side of the housing, a track portion is shown comprising a roller support rail 600 having a number of axles 602 with rolling mobilizers comprising rollers 604 mounted thereon provide a rolling surface for a flat carriage 606 having a magnet 608 mounted thereunder. On the right-hand side of the housing, a track portion 610 is shown with a set of rolling mobilizers comprising a set of bearings mounted and contained therein is fixed to the inside surface of housing 32, the bearings projecting beyond the track portion 610 to allow the flat carriage 606 to roll therealong. FIG. 17*b* shows a side sectional view of the track portion 610. As will be appreciated, the two rolling mobilizer assembly portions can be used in combination, as shown, or a pair of either of the rolling mobilizer portions can be provided.

Figure 17C:
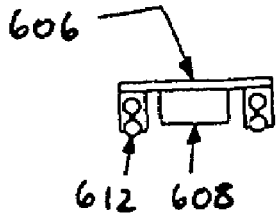
Figure 17D:
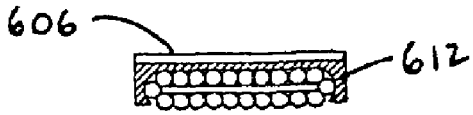

FIGS. 17*c* and 17*d* are front and side sectional views of a variant of the rolling mobilizer assembly shown in FIGS. 17*a* and 17*b*, wherein a set of carriage tracks 612 having bearings enclosed therein is affixed to the flat carriage 606 bearing the magnet 608 to provide the rolling means.

Figure 18:
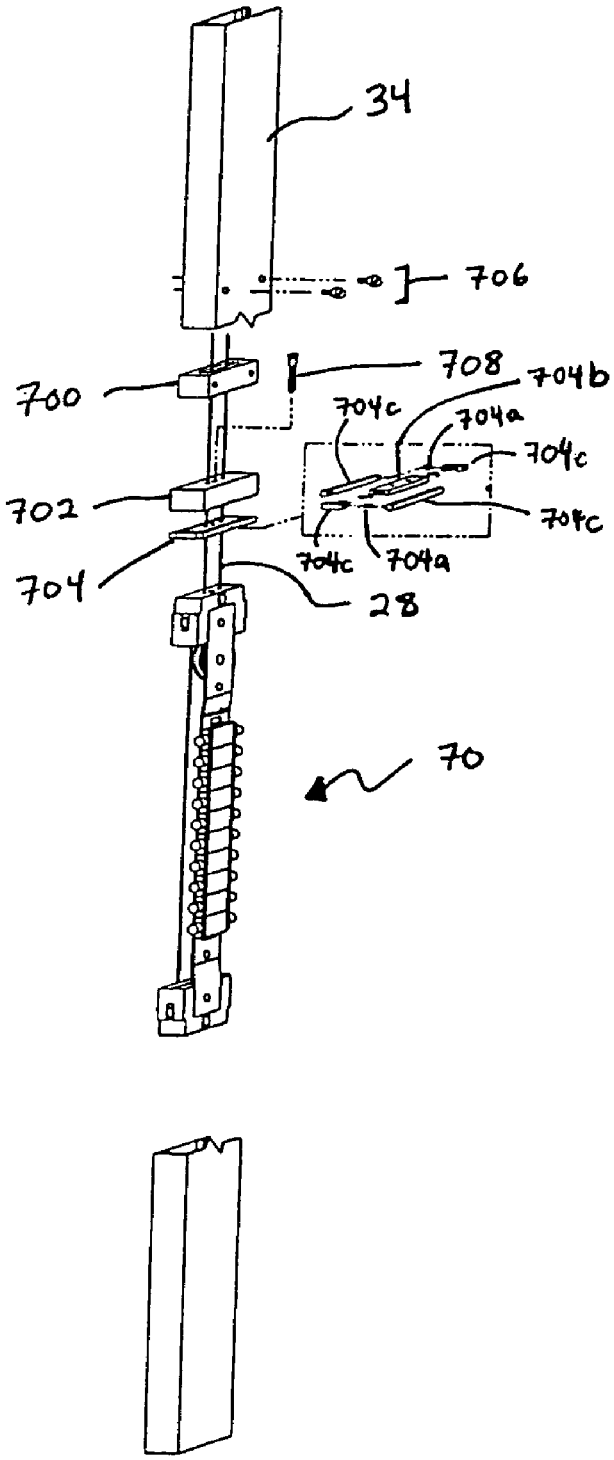
FIG. 18 is an exploded perspective view of another embodiment of a raise/lower mechanism including a stop and tangle inhibitor.

FIG. 18 shows another embodiment of a raise/lower mechanism including a mechanical stop 700 and a tangle inhibitor 701 disposed within the housing 34 above the inner follower carriage and guide assembly 70. The mechanical stop 700 is positioned within the housing 34 at the upper travel limit of the inner follower carriage and guide assembly 70 and external carriage assembly 72, and is affixed to the housing 34 by fastener screws 706 passing through the housing 34 and the mechanical stop 700. The tangle inhibitor 701 includes a wiper-bumper 702 and an isolating bumper 704. The wiper-bumper 702 is secured to the isolating wiper 704 and the inner follower carriage and guide assembly 70 by a screw 708. Each of the mechanical stop 700, the wiper-bumper 702 and the isolating wiper 704 are provided with two through-holes through which the raise/lower line 28 passes.

The wiper-bumper 702 and the isolating wiper 704 are closely fitted to the inner walls of the housing 34 to define a cavity between the upper surface of the wiper-bumper 702 and the mechanical stop 700. The cavity confines the raise/lower line 28 to inhibit the raise/lower line 28 from becoming entangled with inner follower carriage and guide assembly 70. At the same time, the wiper-bumper 702 and the isolating wiper 704 produce little or no resistance to linear sliding movement of the inner follower carriage and guide assembly 70 within the housing 34.

As will be appreciated, the tangle inhibitor 701 inhibits the raise/lower line 28 from getting caught or entangled about or under the wheels of the inner follower carriage and guide assembly 72 or between the inner follower carriage and guide assembly and the walls of the housing when the venetian blind is lowered. Such tangling of the raise/lower line is most likely to occur when the venetian blind is raised creating slack in the raise/lower line 28 and then lowered or "dropped" very quickly. Rapid movement of the inner follower carriage and guide assembly 72 upwards may cause an equally rapid accumulation of the raise/lower line just above of the inner follower carriage and guide assembly inside the housing.

Slack created in the raise/lower line may form a "mass" that gets compressed and compacted by upward movement of the inner carriage and guide assembly 70. This compression may lead to resistance of the movement of the raise/lower line and/or entanglement. By maintaining the slack in the raise/lower line 28 in the cavity above the inner follower carriage and guide assembly 70 through use of the tangle inhibitor 701, these problems are avoided The isolating wiper 704 is best illustrated in the magnified exploded portion of FIG. 18 and includes a plurality of springs 704*a*, spring plates 704*b* and wiper strips 704*c* that co-operatively function to seal/isolate slack in the raise/lower line 28 from the inner follower carriage and guide assembly 70. The spring elements 704*a* apply pressure to the wiper strips 704*c* that contact the inner walls of housing 34. Alternatively, springs or resilient surfaces can be incorporated into the upper and lower faces of the isolating wiper 704 so that it can absorb impact, decreasing the requirement to use the isolating wiper 704 in conjunction with the wiper-bumper 702.

The mechanical stop 700 halts continued upward travel of the inner follower carriage and guide assembly 70 along the housing 34. This facilitates magnetic recoupling of the external carriage assembly 72 and the internal follower carriage and guide assembly 70 in the event that they inadvertently become magnetically decoupled. The mechanical stop 700 is constructed of a resilient material, such as, for example, rubber and is designed to withstand recurring impacts.

In the embodiment illustrated in FIG. 18, the wiper-bumper 702 is a "fixed" single element, namely a homogenous piece of resilient material that performs a dual function. First, wiper-bumper 702 isolates the raise/lower line 28 from the inner follower carriage and guide assembly 70. Additionally, wiper-bumper 702 absorbs energy resulting from impacts between the inner follower carriage and guide assembly 70 and the mechanical stop 700.

The isolating wiper 704 only serves as a wiper and does not provide resilient means to absorb any impact energy.

To protect the raise/lower line 28 from impact damage when the isolation wiper-bumper 702 impacts the mechanical stop 700, both the mechanical step 700 and wiper-bumper 702 are furnished or manufactured with soft, non-wear materials, i.e. felt, rubber or similar components.

Those of skill in the art will appreciate that each of the mechanical stop 700, the wiper-bumper 702 and the isolating wiper-bumper 704 can be used alone or in combination with each other.

As mentioned above, when the slider 160 is raised, the raise/lower line 28 collects within the cavity between the wiper-bumper 702 and the mechanical stop 700 inhibiting the raise/lower line 28 from becoming entangled with the inner follower carriage and guide assembly 70. If desired an accumulator can be placed within the cavity to control the manner in which the raise/lower line 28 collects.

Figure 19:
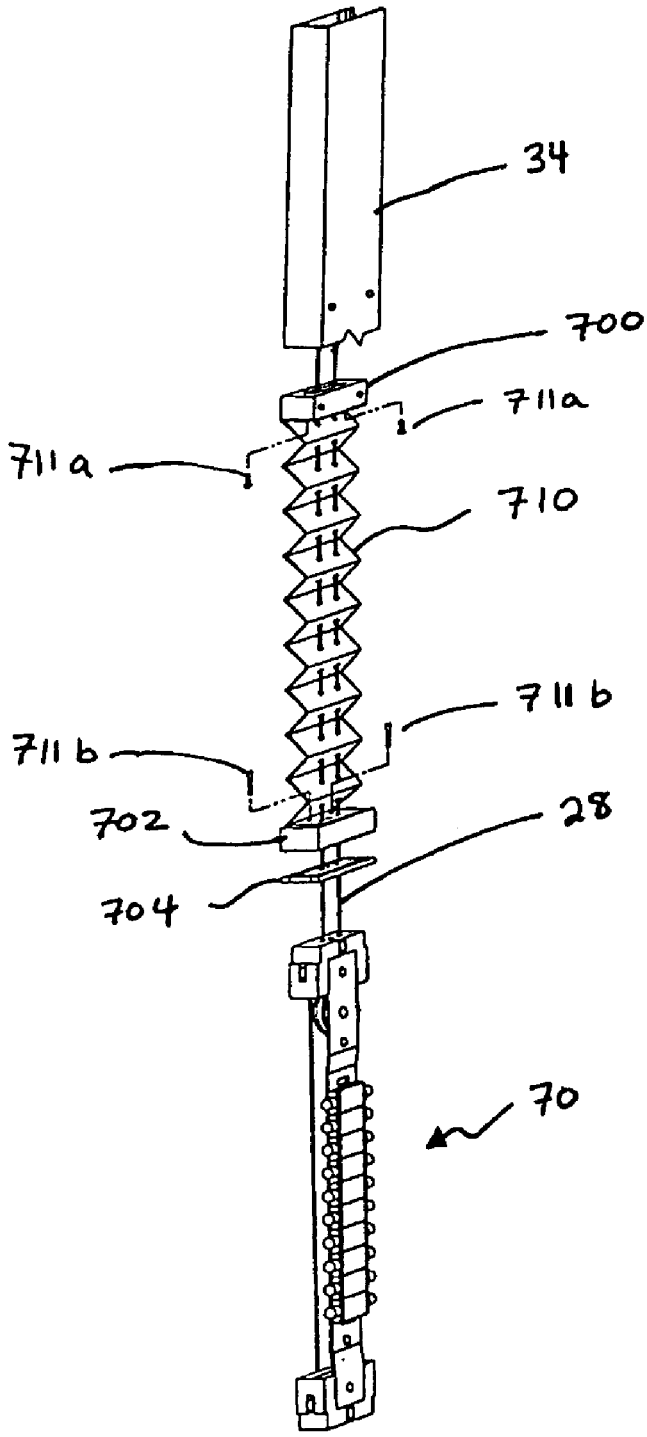
FIG. 19 is a perspective view of yet another embodiment of a raise/lower mechanism including a folding accumulator.

FIG. 19 illustrates a folding accumulator 710 disposed within the housing 34 between the mechanical sop 700 and the wiper-bumper 702. The folding accumulator 710 in this embodiment is a fan-like member made of a very thin, flexible, non-abrasive, wear resistant material and having a number of folds defining segments. The folding accumulator 710 is secured, at its top end, to the mechanical stop 700 by two fastening screws 711*a*. Alternately, the top of the folding accumulator 710 can be secured to the mechanical stop 700 by means of other fasteners or an adhesive. The lower end of the folding accumulator 710 is secured to the wiper-bumper 702 via a pair of screws 711*b*. The lower end of the folding accumulator 710 can also be attached to the wiper-bumper 702 via an adhesive or other means of attachment. The folding accumulator 710 acts to fold or bend the raise/lower line 28 to gather it in a more organized fashion within the cavity as the raise/lower line 28 collects, thus making it easier for the raise/lower line 28 to unravel and extend as the venetian blind 22 is lowered. Little or no clamping force on the raise/lower line 28 or resistance to movement of the raise/lower line 28 is caused by the folding accumulator 710 due to its flexibility and smooth internal and external surfaces. The folding accumulator 710 also serves to protect the raise/lower line 28 from surface friction and wear against the inner walls of the housing 34.

Figure 20:
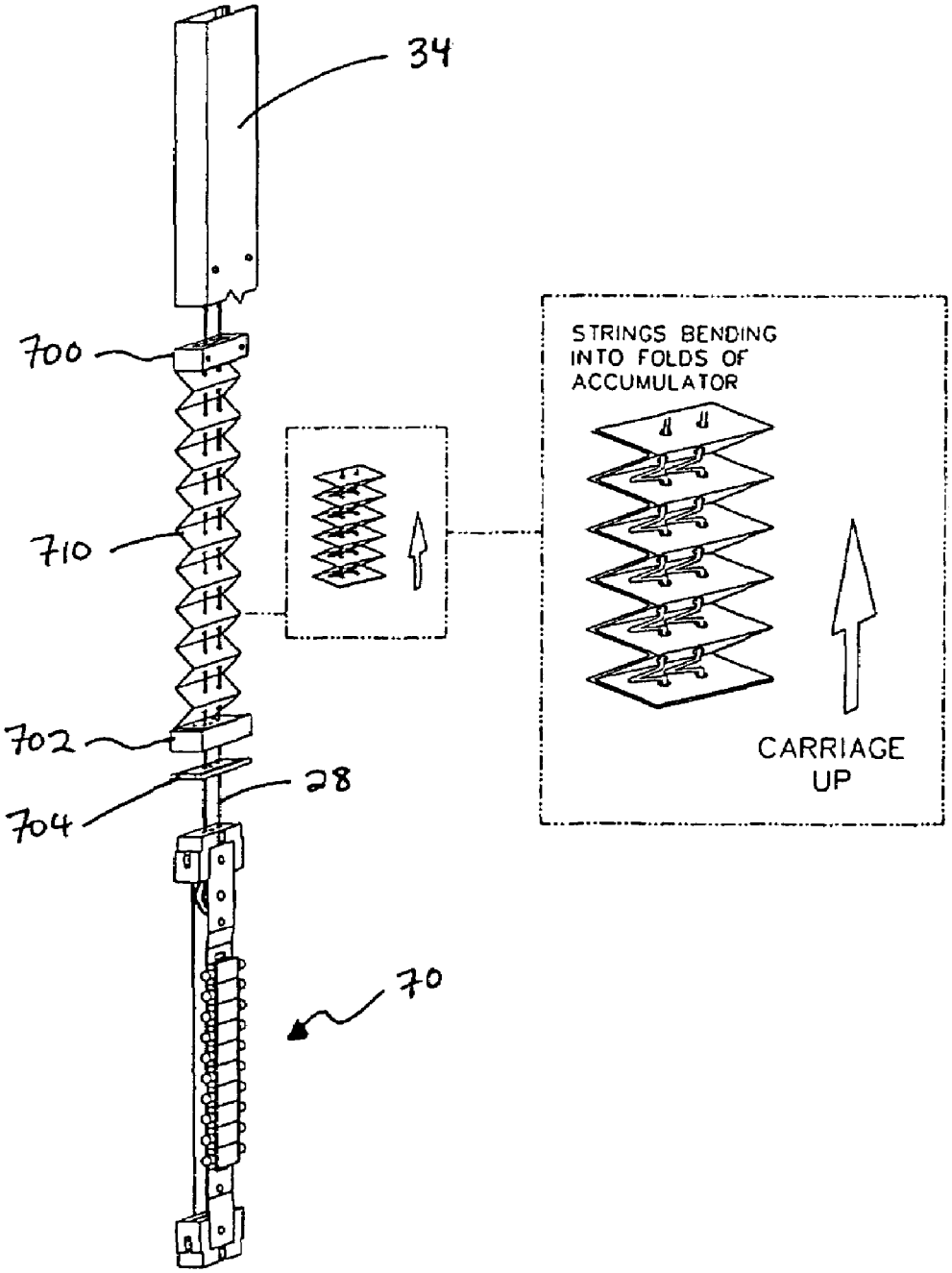
FIG. 20 is another perspective view of the raise/lower mechanism of FIG. 19.

FIG. 20 illustrates the folding accumulator 710 in a partially folded condition. As is shown, slack created in the raise/lower line 28 is gathered between the folds of the folding accumulator 710.

Figure 21A:
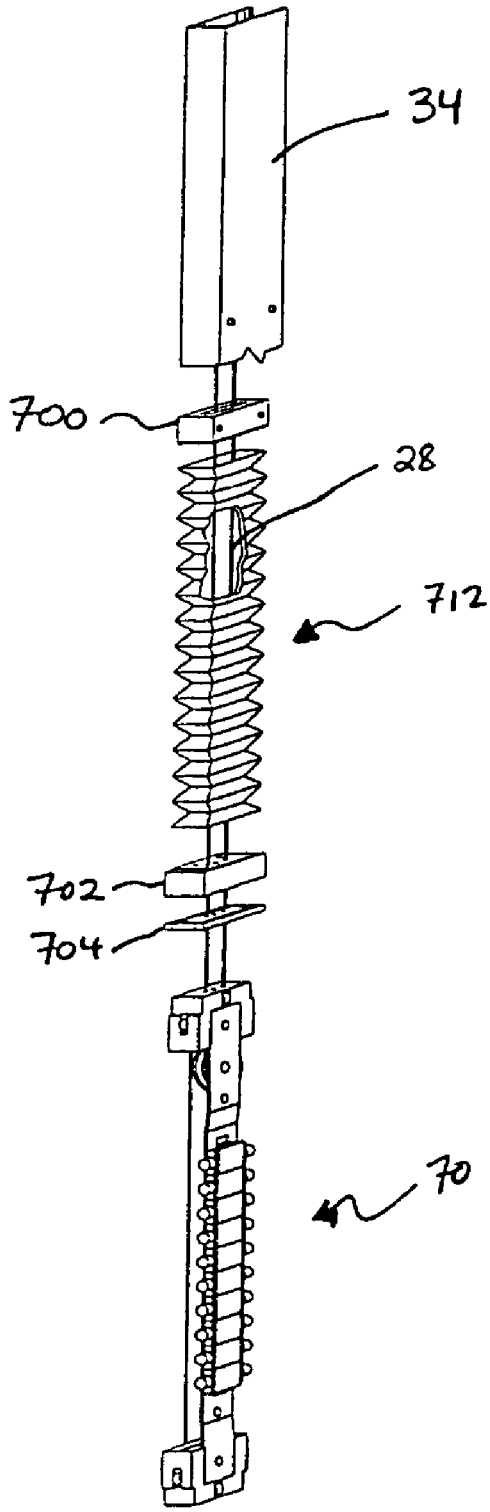
FIG. 21*a* is a perspective view of yet another embodiment of a raise/lower mechanism including an accordion-style folding accumulator.

FIG. 21*a* shows an alternative embodiment of a folding accumulator 712. In this example, the folding accumulator 712 is tubular and completely surrounds the raise/lower line 28. The folding accumulator 712 is shaped to form an accordion tubular member having folding walls and a through-passage through which the raise/lower line 28 is routed. A section of the folding accumulator 712 is cut away for illustrative purposes to expose the raise/lower line 28. In this figure, the raise/lower line 28 is under tension and not gathering.

Figure 21B:
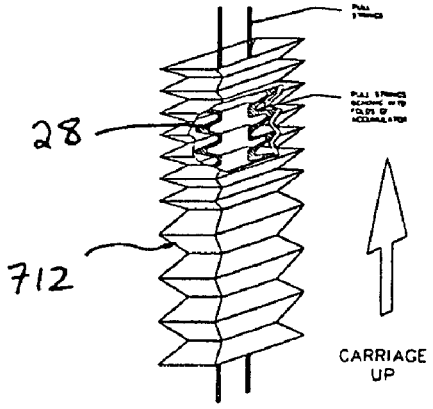
FIG. 21*b* is a perspective view, partly cut-away, of the according-style folding accumulator of FIG. 21*a;*

FIG. 21*b*, shows the folding accumulator 712 in a partially folding condition. As is shown, the folding walls of the folding accumulator operably gather slack in the raise/lower line 28.

The folding accumulator may also be furnished with internal elements or dividers to improve the folding and retraction performance of the raise/lower line 28 within the accumulator. Such elements can include pins, folding membranes, strings, fins, flexible spirals, etc.

Figure 22A:
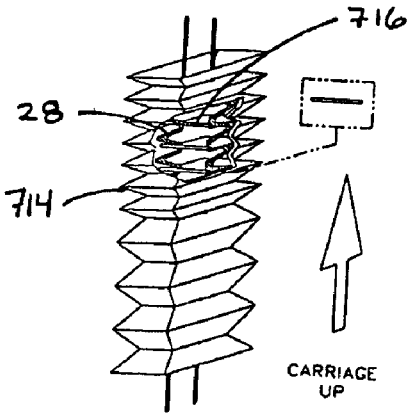
FIGS. 22*a* to 22*c* are perspective views, partly cut-away, of alternative embodiments of folding accumulators.
Figure 22B:
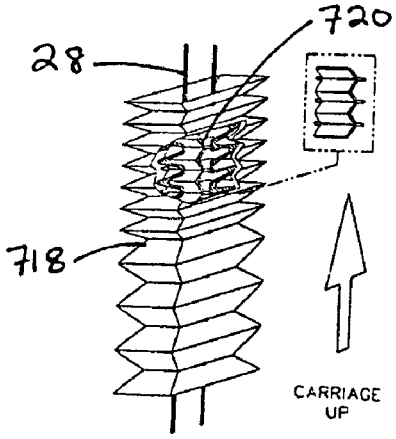

For example, FIG. 22*a* shows a folding accumulator 714 similar to that of FIGS. 21*a* and 21*b*, but including a number of internal dividing posts 716 that assist in the gathering of the raise/lower line 28. FIG. 22*b* shows a folding accumulator 718 similar to that of FIGS. 21*a* and 21*b*, but including an internal folding wall 720 connected to a set of internal dividing posts that collectively induce excess length of the raise/lower line 28 to gather.

As will be appreciated, the accumulators can be "open" to various degrees or fully closed. In the "open" configuration as illustrated in FIGS. 19 and 20, at least a portion of the accumulator is open to the inner walls of the housing 34, in which case the raise/lower line 28 may be exposed to, and come in contact with, the inner walls of the housing 34. In the closed configuration as illustrated in FIGS. 21*a* to 24, there is no direct contact between the raise/lower line 28 and the walls of the housing 34, reducing friction and were on the raise/lower line 28. Although closed accumulators reduce friction and were on the raise/lower line 28, an open configuration reduces the space utilized by the folding accumulator.

Figure 22C:
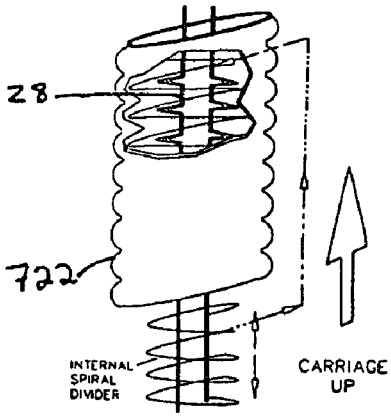

Although the folding accumulators illustrated in FIGS. 19 to 21*b* are of the linear accordion-type, other types of folding accumulators can be used such as for example spiral accordions and telescoping mechanisms. For example, FIG. 22*c* shows an example of a spiral accordion 722 having an internal spiral divider for encouraging any excess length of raise/lower line 28 to collect therein.

Figure 23:
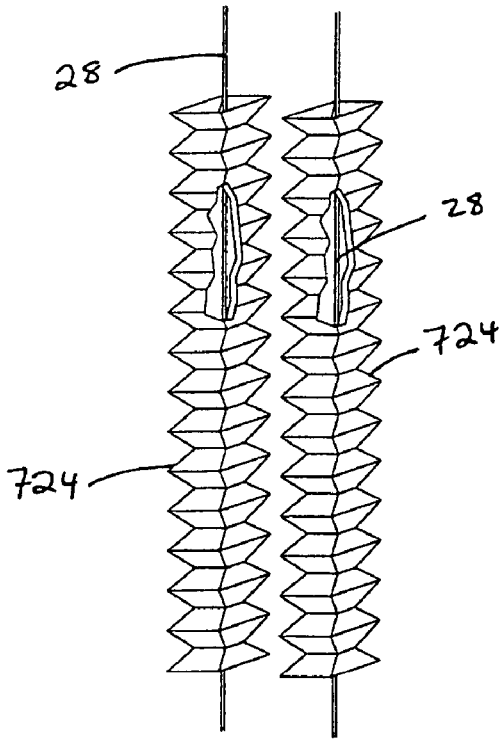
FIG. 23 is a perspective view, partly cut-away, of yet another embodiment of a folding accumulator.
Figure 24:
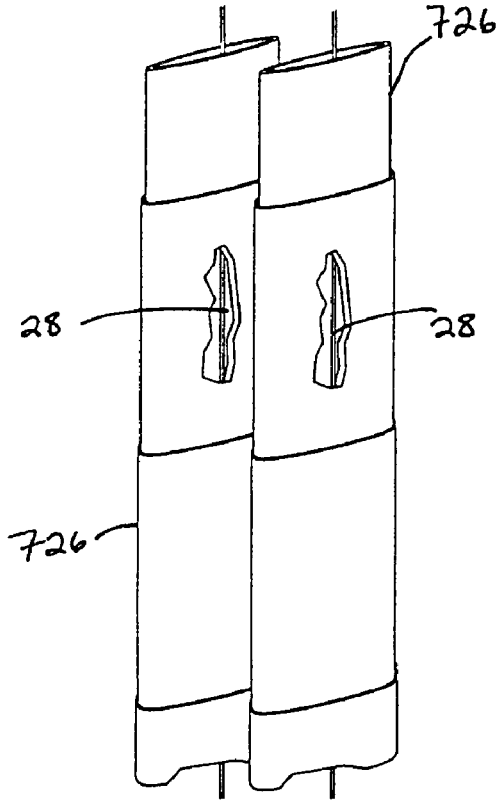
FIG. 24 is a perspective view, partly cut-away, of a telescopic accumulator.

FIGS. 23 and 24 illustrate the placement of folding accumulators around each section of raise/lower line 28. In FIG. 23, the folding accumulator 724 is of the type shown in FIG. 12*a*.

In FIG. 24, the accumulator 726 is of the telescopic-type having a through-passage through which the raise/lower line 28 is routed. The accumulator 726 includes a number of sections that interleave in a compressed condition. Where such a telescopic accumulator is made of rigid sections, the positioning of the mechanical stop 700 can be adjusted to compensate for the fixed length of the compressed telescopic accumulator 726.

Figure 25:
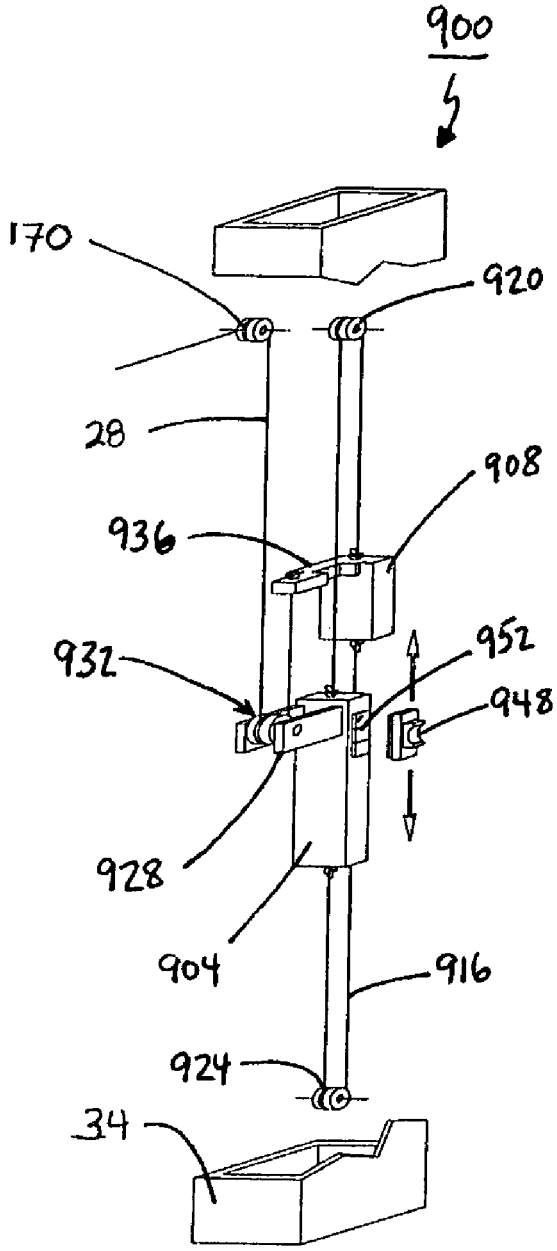
FIG. 25 is a perspective view of still yet another embodiment of an inner carriage and guide assembly including a multiplier.
Figure 26:
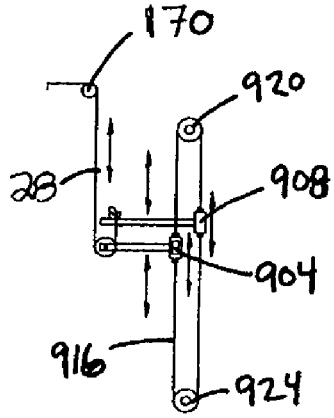
FIG. 26 is a schematic front elevation view of the inner carriage and guide assembly of FIG. 25.

FIGS. 25 to 32 show alternative embodiments of raise/lower mechanisms including multipliers. In particular, FIGS. 25 and 26 show an alternative raise/lower mechanism 900 including a follower assembly comprising a lower elevator 904 and an upper elevator 908 slidably received in the inner housing 34. The lower elevator 904 and the upper elevator 908 are connected via an elevator line 916 looped around a top elevator pulley 920 and a bottom elevator pulley 924 such that movement of the lower elevator 904 in one direction along the interior of the housing 34 is mirrored by movement of the upper elevator 908 in the opposite direction. The lower elevator 904 has a bracket 928 supporting a multiplier pulley 932 that is rotatably mounted therein. The upper elevator 908 includes an arm 936 to which the raise/lower line 28 is secured. From the arm 936 of the upper elevator 908, the raise/lower line 28 routes around the multiplier pulley 932 of the lower elevator 904 and then travels up and over the fixed pulley 170. An external slider carriage 948 is magnetically coupled to a set of magnets 952 secured to the side of the lower elevator 904.

As will be appreciated, downward movement of the slider carriage 948 and hence lower elevator 904 causes upward movement of the upper elevator 908, both lengthening the span between the arm 936 of the upper elevator 908 and the multiplier pulley 932, and the span between the multiplier pulley 932 and the pulley 170. This, in turn, causes the venetian blind to be raised and lowered. In this arrangement, the multiplier has a trebling effect so that one inch of movement of the external slider carriage 948 and hence, one inch of movement of the lower elevator 904, raises or lowers the venetian blind by three inches.

Figure 27:
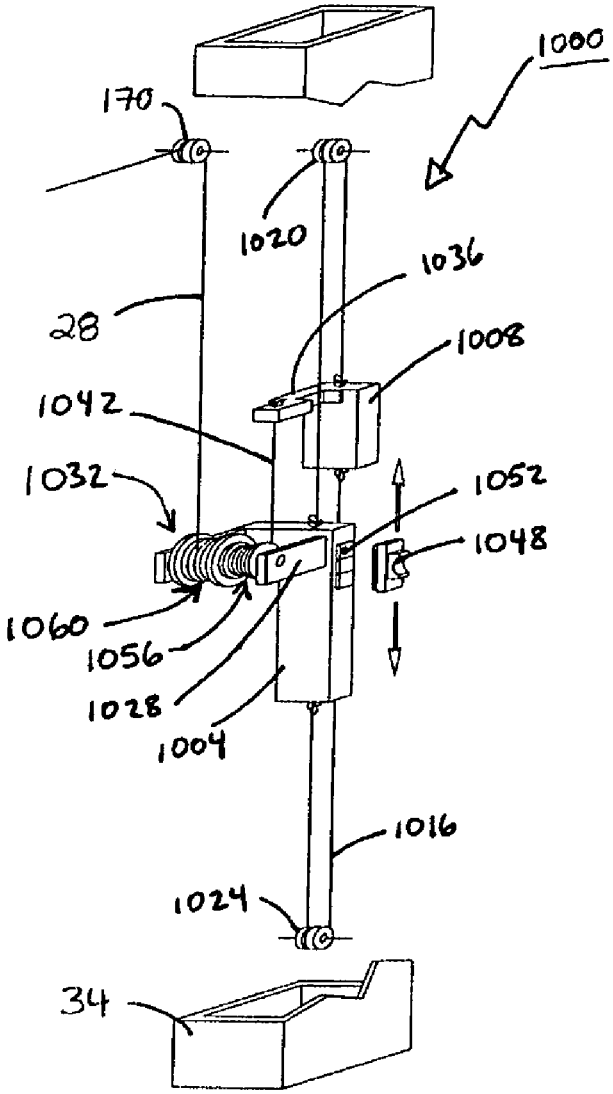
FIG. 27 is a perspective view of still yet another embodiment of an inner carriage and guide assembly including a multiplier.
Figure 28:
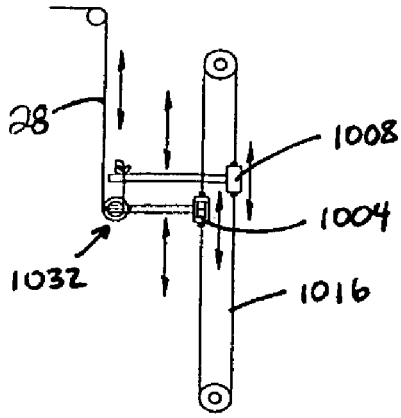
FIG. 28 is a schematic front elevation view of the inner carriage and guide assembly of FIG. 27.

Another alternative raise/lower mechanism 1000 similar to that of FIGS. 25 and 26 is shown in FIGS. 27 and 28. In this embodiment, the raise/lower mechanism includes a follower assembly comprising a lower elevator 1004 and an upper elevator 1008 slidably received in the inner housing 34. The lower elevator 1004 and the upper elevator 1008 are connected via an elevator line 1016 looped around a top elevator pulley 1020 and a bottom elevator pulley 1024 such that movement of the lower elevator 1004 in one direction along the interior of the housing 34 is mirrored by movement of the upper elevator 1008 in the opposite direction. The lower elevator 1004 has a bracket 1028 supporting a two-step multiplier pulley 1032 that is rotatably mounted therein. The two-step multiplier pulley 1032 is segmented effectively to provide a smaller circumferenced pulley portion 1056 and a larger circumferenced pulley portion 1060. The upper elevator 1008 has an arm 1036. The raise/lower line 28 is secured to and pre-wound around the larger pulley portion 1060 a number of times before traveling up and over the pulley 170. A wind line 1042 is secured to and pre-wound around the smaller pulley portion 1056 a number of times before traveling up to the arm 1036, to which it is secured.

An external slider carriage 1048 is magnetically coupled to a set of magnets 1052 secured to the side of the lower elevator 1004.

Upon downward movement of the external slider carriage 1048 and hence lower elevator 1004, the upper elevator 1008 travels upward, lengthening the span between the arm 1036 of the upper elevator 1008 and the two-step multiplier pulley 1032. As tension is placed on the wind line 1042, the wind line 1042 places torque on the two-step multiplier pulley 1032, causing it to turn. Turning of the two-step multiplier pulley 1032 unwinds the wind line 1042 wound around the smaller pulley portion 1056 and, in turn, pulls and winds the raise/lower line 28 around the larger pulley portion 1060. It will be appreciated that the length of the raise/lower line 28 wound around the two-step multiplier pulley 1032 during a rotation thereof is greater than the length of the wind line 1042 that is wound therearound, thus providing a multiplier effect. As the lower elevator 1004 moves downwards, the span between the multiplier pulley 1032 and the pulley 170 increases, thus increasing the speed at which the raise/lower line 28 is drawn around the pulley 170.

Upon upward movement of the slider carriage 1048, the arm 1036 and the bracket 1028 move towards one another, and the wind line 1042 and the raise/lower line 28 loosen while the venetian blind drop under the force of gravity. The gravitational pull tightens the wind line 1042 and the raise/lower line 28 which produces a rotational torque that acts to wind the wind line 1042 on the smaller pulley portion 1056.

In this particular arrangement, the multiplier generally has a trebling effect so that one inch of movement of the external slider carriage 1048 and, hence, one inch of movement of the lower elevator 1004, raises or lowers the venetian blind by three inches. It will be appreciated, that alteration of the ratio of the circumferences of the smaller and larger pulley portions 1056, 1060 will increase or decrease the multiplier effect of the two-step multiplier pulley and, thus, the overall multiplier effect.

Figure 29:
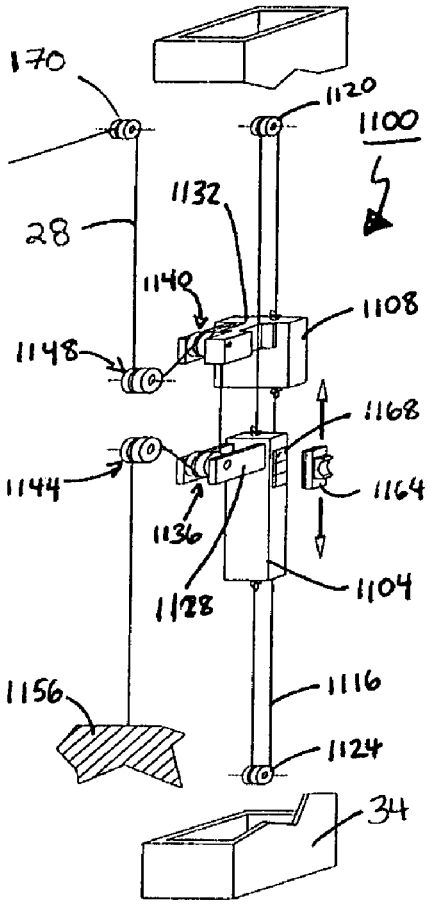
FIG. 29 is a perspective view of still yet another embodiment of an inner carriage and guide assembly including a multiplier.
Figure 30:
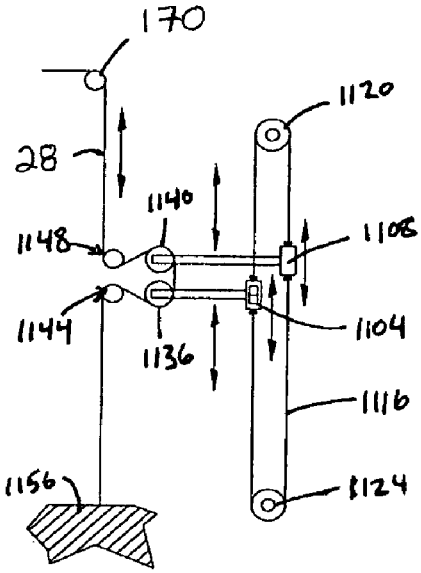
FIG. 30 is a schematic front elevation view of the inner carriage and guide assembly of FIG. 29.

FIGS. 29 and 30 show yet another embodiment of a raise/lower mechanism 1100 similar to that of FIGS. 25 and 26. In this embodiment, the raise/lower mechanism includes a follower assembly comprising a lower elevator 1104 and an upper elevator 1108 slidably received in the inner housing 34. The lower elevator 1104 and the upper elevator 1108 are connected via an elevator line 1116 looped around a top elevator pulley 1120 and a bottom elevator pulley 1124 such that movement of the lower elevator 1104 in one direction along the interior of the housing 34 is mirrored by movement of the upper elevator 1108 in the opposite direction. The lower and upper elevators 1104, 1108 have brackets 1128 and 1132 respectively. A lower pulley 1136 is mounted on bracket 1128 and an upper pulley 1140 is mounted on bracket 1132. A lower fixed idler pulley 1144 and an upper fixed idler pulley 1148 are secured within the inner housing 34 and spaced apart to provide free rotation of the pulleys 1136, 1140. The raise/lower line 28 is secured to the bottom of the window frame 1156 and routed around the lower fixed idler pulley 1144, the lower pulley 1136, the upper pulley 1140, the upper fixed idler pulley 1148 and then the pulley 170. A slider carriage 1164 is magnetically coupled to a set of magnets 1168 secured to the lower elevator 1104.

Downward movement of the external slider carriage 1164 and hence lower elevator 1104 causes the upper elevator 1108 to travel upward, lengthening the span between the brackets 1128, 1132 of the lower and upper elevators 1104, 1108. As the raise/lower line 28 is routed around the lower and upper fixed idler pulleys 1144, 1148, and as brackets 1128, 1132 move apart from each other, a multiplier of three to four is achieved so that one inch of movement of the external slider carriage 1164 and, hence, one inch of movement of the lower elevator 1104, raises or lowers the venetian blind by three to four inches. Upward movement of the external slider carriage 1164 causes the raise/lower line 28 to loosen thereby to lower the venetian blind.

Figure 31:
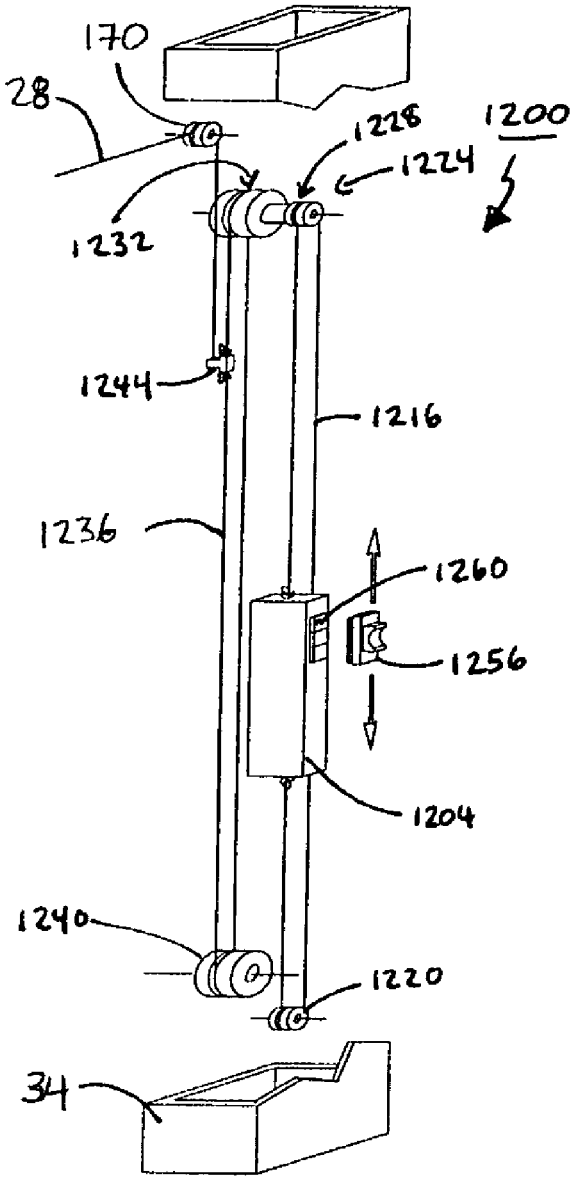
FIG. 31 is a perspective view of still yet another embodiment of an inner carriage and guide assembly including a multiplier.
Figure 32:
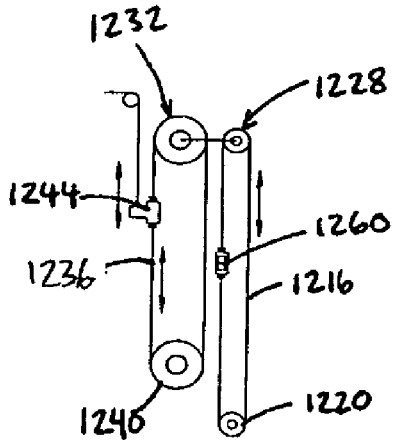
FIG. 32 is a schematic front elevation view of the inner carriage and guide assembly of FIG. 31.

FIGS. 31 and 32 show still yet another embodiment of a raise/lower mechanism 1200. In this embodiment, the raise/lower mechanism includes a follower assembly comprising an elevator 1204 slidably received in the inner housing 34. The elevator 1204 is connected to an elevator line 1216 looped around a bottom elevator pulley 1120 and a two-step multiplier pulley 1224. The two-step multiplier pulley 1224 has a smaller circumferenced pulley portion 1228, around which the elevator line 1216 is routed, and a larger circumferenced pulley portion 1232. A secondary elevator line 1236 is routed around the larger pulley portion 1232 of the two-step multiplier pulley 1224 and around a secondary bottom pulley 1240. Coupled to the secondary elevator line 1236 is a secondary elevator 1244 that provides a point of securing for the raise/lower line 28. The raise/lower line 28 is routed around the pulley 170. An external slider carriage 1256 is magnetically coupled to a set of magnets 1260 secured to the elevator 1204.

Downward movement of the slider carriage 1256 and hence the elevator 1204 causes the elevator line 1216 to apply a torque force to the two-step multiplier pulley 1224. As the two-step multiplier pulley 1224 is rotated under the torque force, the secondary elevator line 1236 is rotated with it. The secondary elevator 1244 is accordingly moved downwardly with the secondary elevator line 1236, pulling the raise/lower line 28 around the pulley 170 and raising the venetian blind. The secondary elevator line 1236 provides a dampening effect for any force transmitted to the secondary elevator 1244 by the venetian blind during lowering. In this particular arrangement, the multiplier has a variable effect depending on the ratio of the smaller and larger pulley portions 1228, 1232 of the two-step pulley 1224.

Other means for transmitting movement between the elevators and the raise/lower line will occur to those skilled in the art. For example, belts or chains could replace the various elevator lines. Where chains are used, the pulleys could be provided with sprocket teeth.

As will be appreciated by those skilled in the art, the alternative raise/lower mechanisms described above can benefit from combination with the clutch mechanisms discussed herein.

FIGS. 33 to 36 show yet another embodiment of a magnetic raise/lower mechanism for use with the multi-pane window, wherein the rolling mobilizers have been replaced with an alternative friction reducing arrangement that includes sliding elements. In particular, in this embodiment the raise/lower mechanism includes an inner follower slider carriage 1304 that is secured to the raise/lower line 28 and slidably mounted inside the inner housing. The inner follower slider carriage 1304 is in sliding contact with a vertically aligned anti-friction surface 1308 secured to the inside surface of one of the panes of glass 1360. An external slider carriage 1312 is slidably mounted inside the external housing. The external slider carriage 1312 is in sliding contact with a vertically aligned anti-friction surface 1316 secured to the outside surface of the pane of glass 1360. The anti-friction surfaces 1308, 1316 are positioned to effectively form a sandwich with the glass pane.

A slider pad 1320 on the undersurface of the inner follower slider carriage 1304 is shown having a structured sliding surface comprising of a number of raised protrusions with cavities therebetween. The protrusions are rounded and provide a suitable sliding surface. A number of inserts 1324 are inserted into the cavities and secured therein via an adhesive, fusion or the like. The inserts 1324 act to reduce friction between the inner follower slider carriage 1304 and the anti-friction surface 1308. In the present embodiment, the inserts 1324 are made from felt, but can also be made from resilient rubber, foam rubber, mesh, etc. The inserts 1324 are designed to resist compression and friction, and can be impregnated with a lubricant in order to further reduce friction with the anti-friction surface.

Figure 34:
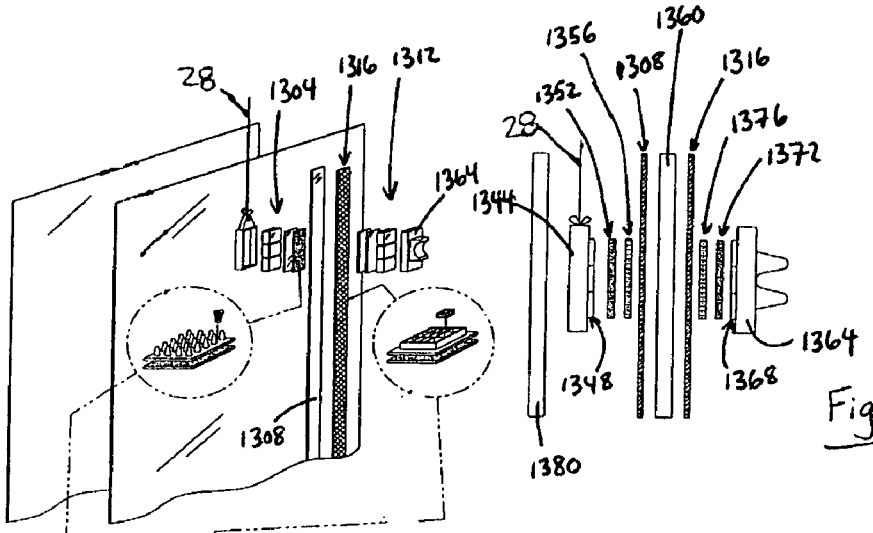
FIG. 34 is an exploded schematic side view of the raise/lower mechanism of FIG. 33.

FIG. 34 better illustrates the slider carriages 1304, 1312. The inner follower slider carriage 1304 is shown having a slider body 1344 onto which are affixed three magnets 1348. Secured to the magnets 1348 is a resilient pad 1352 of foam rubber, felt, or another suitable material. The resilient pad 1352 acts to distribute the pressure from magnetic forces more evenly to predetermined mating contact areas. A slider pad 1356 similar to slider pads 1320 and 1328 is affixed to the resilient pad 1352. The slider pad 1356 may be fused and integrated into the structure of the resilient pad 1352 and can be impregnated with a lubricant, such as silicone or poly disulfide. As mentioned above, the inner follower slider carriage 1304 is in intimate sliding contact with the anti-friction surface 1308 affixed to the glass pane 1360. The anti-friction surface 1308 can be any suitable surface for allowing free sliding travel of the inner follower slider carriage 1304 thereover, such as a nylon pad, a tape or an applied or fused coating applied to the surface of the glass pane 1360, such as Teflon, over which the inner follower slider carriage 1304 is expected to travel.

A slider pad 1328 on the undersurface of the external slider carriage 1312 is shown having a sliding surface 1330 comprising a celled structure having a number of cells. The edges of the celled structure are level and provide a suitable sliding surface. The celled structure may be metallic, non-metallic or some combination of both. The sliding surface 1330 of the celled structure can be of a low friction material, such as Teflon® or Nylatron. Contact pads 1332 are inserted into the cells of the celled structure and secured therein. The contact pads 1332, like the inserts 1324, act to reduce friction between the slider carriage and the anti-friction surface 1316 and resist compression. The contact pads 1332 can be constructed of felt, resilient rubber, foam rubber, mesh or the like.

The external slider carriage 1312 is shown having an external control comprising a slider 1364 onto which are affixed three magnets 1368. Secured to the magnets 1368 is a resilient pad 1372 of foam rubber, felt, or another suitable material, and a slider pad 1376 such as slider pads 1320 and 1328. The external slider carriage 1312 as mentioned above is in intimate sliding contact with the anti-friction surface 1316 affixed to the glass pane 1360 opposite the anti-friction surface 1308. The anti-friction surface 1316 is also constructed in a similar manner to the anti-friction surface 1308.

Upon downward movement of the external slider carriage 1312, the magnetically-coupled inner follower slider carriage 1304 mirrors its movement, pulling raise/lower line 28 downward. In turn, the raise/lower line 28 pulls on the venetian blind to raise it. Upward movement of the external slider carriage 1312 releases the raise/lower line 28 to lower the venetian blind.

Figure 33:
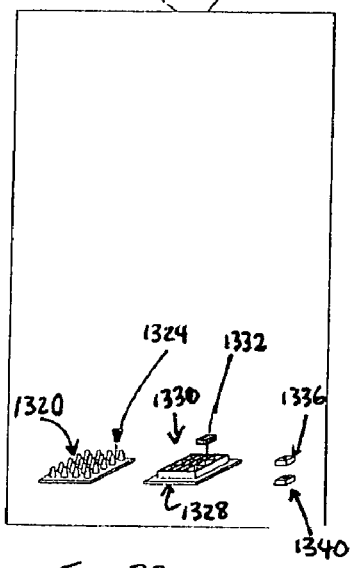
FIG. 33 is an exploded perspective view of yet another embodiment of a magnetic raise/lower mechanism.
Figure 35:
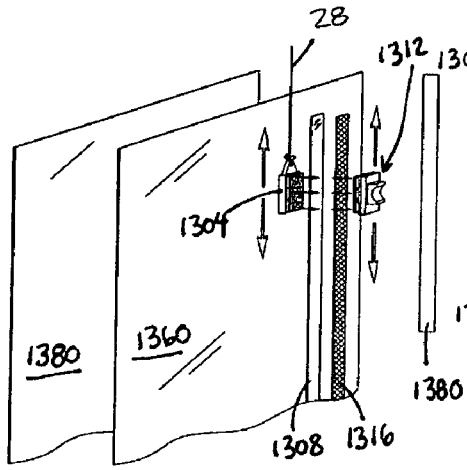
FIG. 35 is another perspective view of the raise/lower mechanism of FIG. 33.
Figure 36:
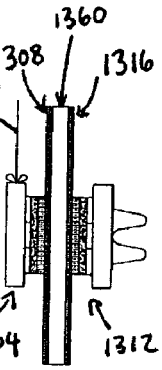
FIG. 36 is another schematic side view of the raise/lower mechanism of FIG. 33.

A pair of alternative contact pads 1336, 1340 is also shown in FIG. 33. The first alternative contact pad 1336 has a ball-bearing mounted therein and the second alternative contact pad 1340 has a roller mounted therein. Both the balls and the rollers can be static on dynamic. Static balls and rollers could have surfaces of Teflon, Nylatron or the like.

Other forms of structured sliding surfaces will occur to those skilled in the art.

While the celled structure of the slider pad 1328 is shown having a linear array of rectangular cells, it will be understood by those skilled in the art that the cells can be provided in a number of configurations without significantly decreasing the effectiveness of the slider pad 1328. For example, parallelogram-shaped cells and honeycomb-patterned cells have been found to work satisfactorily. Additionally, it is to be understood that either of the two undersurface configurations (that is, inserts or contact pads) or a combination thereof can be employed on each slider carriage.

One or both of the anti-friction surfaces 1308, 1316 can be constructed in the same manner as the slider pads 1320, 1328. Where the anti-friction surfaces 1308, 1316 are constructed with slider pads having dynamic balls or rollers, decreased friction can be provided between the slider carriages 1304, 1312 and the anti-friction surfaces 1308, 1316.

As will be appreciated by those skilled in the art, the slider carriages 1304 and 1312 can be used in combination with the clutch and multiplier mechanisms described previously. Also, arrangements including slider carriages and wheeled assemblies can be used in either or both of the raise/lower and tilt mechanisms.

Although preferred embodiments of the present invention have been described, those of skill in the art will appreciate that variations and modifications may be made without departing from the spirit and scope thereof.

What is claimed is:

1. A multi-pane window having a magnetic mechanism for actuating a venetian blind disposed between inner and outer glass panes thereof, the magnetic mechanism comprising:

an inner follower carriage disposed between the glass panes and being operable to actuate said venetian blind when moved;

an external housing disposed on a surface of the inner glass pane opposite to the inner follower carriage, the external housing having an external carriage disposed therein magnetically coupled to said inner follower carriage via said inner glass pane, said external carnage being moveable with respect to the external housing to move said inner follower carriage, and movement of the external carriage being guided by the external housing;

at least one friction reducing element to facilitate movement of at least one of said carriages over the inner glass pane; and a clutch coupled to said external carriage, said clutch decoupling from said external carriage when a force is applied to said clutch that exceeds a threshold level during movement of said external carriage to inhibit said external carriage and said inner follower carriage from magnetically decoupling, wherein said magnetic mechanism is a raise/lower mechanism coupled to a raise/lower line of said venetian blind.

2. A multi-pane window according to claim 1 wherein said at least one friction reducing element is at least one rolling mobilizer.

3. A multi-pane window according to claim 2, wherein said at least one rolling mobilizer includes at least one wheel set coupled to said inner follower carriage.

4. A multi-pane window according to claim 2, wherein said at least one rolling mobilizer includes at least one wheel set coupled to each of said inner follower carriage and external carriage.

5. A multi-pane window according to claim 4, wherein said inner follower carriage includes at least one U-shaped carriage assembly housing a magnet, and wherein said at least one wheel set is secured to said U-shaped carriage assembly.

6. A multi-pane window according to claim 5, comprising a series of carriage assemblies, said carriage assemblies being coupled to a chassis.

7. A multi-pane window according to claim 6, wherein the couple between each of said carriage assemblies and said chassis is a floating couple.

8. A multi-pane window according to claim 1, wherein said magnetic mechanism is a tilt mechanism comprising:

a spiral actuator rod rotatably supported by at least one cradle assembly and coupled to tilt lines of said venetian blind, said inner follower carriage being operable to rotate said spiral actuator rod thereby to pay in or pay out said tilt lines.

9. A multi-pane window according to claim 8, wherein said at least one cradle assembly comprises:

a set of rollers arranged to form a channel to receive said spiral actuator rod and permit said spiral actuator rod to rotate freely.

10. A multi-pane window according to claim 8, wherein said tilt mechanism further comprises:

a stop operable to inhibit axial movement of said spiral actuator rod.

11. A multi-pane window according to claim 10, wherein said stop comprises a hearing mounted in a thrust plate.

12. A multi-pane window according to claim 2, wherein said at least one rolling mobilizer is at least one set of ball-bearings coupled to said inner follower carriage.

13. A multi-pane window according to claim 2, further comprising:

a track having at least one set of rolling mobilizers rotatably coupled thereto, and wherein said at least one of said inner follower carriage and said external carriage travel along said track atop said rolling mobilizers.

14. A multi-pane window according to claim 13, wherein said rolling mobilizers are wheels.

15. A multi-pane window according to claim 13, wherein said rolling mobilizers are ball-bearings.

16. A multi-pane window according to claim 1 wherein said at least one friction reducing element is at least one rolling mobilizer.

17. A multi-pane window according to claim 16, wherein said at least one rolling mobilizer is at least one wheel set secured to said inner follower carriage.

18. A multi-pane window according to claim 16, wherein said at least one rolling mobilizer is at least one wheel set secured to said inner follower carriage and said external carriage.

19. A multi-pane window according to claim 18, wherein said inner follower carriage comprises: at least one U-shaped carriage assembly housing a magnet, and wherein said at least one wheel set is secured to said U-shaped carriage assembly.

20. A multi-pane window according to claim 19, comprising a series of carriage asemblies, said carriage assemblies being coupled to a chassis.

21. A multi-pane window according to claim 1, wherein the couple between each of said carriage assemblies and said chassis is a floating couple.

22. A multi-pane window according to claim 21, wherein movement of said external carriage is restricted between upper and lower limits.

23. A multi-pane window according to claim 1, further comprising:

at least one stop to limit travel of said inner follower carriage.

24. A multi-pane window according to claim 1, further comprising:

a multiplier operable to increase the pull ratio of said magnetic raise/lower mechanism.

25. A multi-pane window according to claim 24, further comprising:

a tubular housing accommodating said inner follower carriage; and a tangle inhibitor within said housing above said inner follower carriage to inhibit tangling of slack in said raise/lower line.

26. A multi-pane window according to claim 25, further comprising an accumulator within said housing to gather slack in said raise/lower line.

27. A multi-pane window according to claim 1 wherein at least one of said inner follower carriage and said external carriage have a structured sliding surface to facilitate movement of said at least one of said inner follower carriage and said external carriage over said glass panes.

28. A multi-pane window according to claim 27, wherein said structured sliding surface comprises a number of raised protrusions.

29. A multi-pane window according to claim 28, further comprising:

an insert positioned between said protrusions, said insert being impregnated with a lubricant.

30. A multi-pane window according to claim 27, wherein said structured sliding surface is comprised of a celled structure having a number of cells.

31. A multi-pane window according to claim 30, further comprising:

a contact pad inserted into one of said cells.

32. A multi-pane window according to claim 31, wherein said contact pad is impregnated with a lubricant.

33. A multi-pane window according to claim 31, wherein said contact pad is equipped with a ball-bearing.

34. A multi-pane window according to claim 31, wherein said contact pad is equipped with a roller.

35. A multi-pane window according to claim 1 wherein at least one of said inner follower carriage and said external carriage has a sliding surface;

said window further comprising: an anti-friction surface on said glass panes adjacent said at least one of said inner follower carriage and said external carriage.

36. A multi-pane window according to claim 35, wherein said anti-friction surface comprises of a pad.

37. A multi-pane window according to claim 35, wherein said anti-friction surface comprises tape.

38. A multi-pane window according to claim 35, wherein said anti-friction surface comprises an applied coating.

39. A multi-pane window according to claim 35, wherein said anti-friction surface comprises a fused coating.

40. A multi-pane window according to claim 35, wherein said anti-friction surface comprises a structured sliding surface.

41. A multi-pane window having a magnetic raise/lower mechanism for raising and lowering a venetian blind disposed between glass panes thereof, the magnetic raise/lower mechanism comprising:

a raise/lower line coupled to the venetian blind;

an inner follower carriage disposed between the glass panes and operable to actuate said raise/lower line thereby to move said venetian blind, said inner follower carriage including a first plurality of magnetic carriage assemblies arranged adjacent to each other;

an external carriage disposed outside said glass panes and magnetically coupled to said inner follower carriage, said external carriage being moveable to move said inner follower carriage and actuate the raise/lower line and including a second plurality of magnetic carriage assemblies arranged adjacent to each other, the second magnetic carriage assemblies being magnetically coupled to the first magnetic carriage assemblies of said inner follower carriage;

a multiplier acting on the raise/lower line to increase the pull ratio of said magnetic raise/lower mechanism; and a clutch coupled to said external carriage, said clutch decoupling from said external carriage when a force is applied to said clutch that exceeds a threshold level during movement of said external carriage to inhibit said external carriage and said inner follower carriage from magnetically decoupling.

42. A multi-pane window according to claim 41, wherein said multiplier provides a pull ratio of at least two to one.

43. A multi-pane window according to claim 42, wherein said multiplier comprises a pulley coupled to said inner follower carriage and said wherein said raise/lower line is routed around said pulley and secured to a fixed point above said inner follower carriage.

44. A multi-pane window according to claim 42, further comprising:

a first elevator line secured to said inner follower carriage; a two-step pulley having a smaller pulley portion and a larger pulley portion, said first elevator line being routed around said smaller pulley portion; a second elevator line routed around said larger pulley portion; and a secondary elevator secured to said second elevator line and coupled to said raise/lower line.

45. A multi-pane window according to claim 42, wherein said multiplier provides a pull ratio of at least three to one.

46. A multi-pane window according to claim 45, further comprising:

an elevator coupled to said inner follower carriage via an elevator line and operable to move in a direction opposite to said inner follower carriage; and wherein said multiplier comprises a two-step multiplier pulley coupled to said inner follower carriage, said two-step multiplier pulley having a smaller pulley portion and a larger pulley portion; and wherein said raise/lower line is secured to said larger pulley portion; and wherein a wind line is secured at a first end to said elevator and at a second end to said smaller pulley portion.

47. A multi-pane window according to claim 45, further comprising:

an elevator coupled to said inner follower carriage via an elevator line and operable to move in a direction opposite to said inner follower carriage; and wherein said multiplier comprises a pulley coupled to said inner follower carriage; and wherein said raise/lower line is secured to said elevator at a first end and routed around said pulley.

48. A multi-pane window according to claim 45, further comprising:

an elevator coupled to said inner follower carriage via an elevator line and operable to move in a direction opposite to said inner follower carriage; and wherein said multiplier comprises a first pulley coupled to said inner follower carriage, a second pulley coupled to said elevator, and at least one idler pulley, said raise/lower line being secured at one end thereof, routed around said at least one idler pulley, around said first pulley and said second pulley, and back around said at least one idler pulley.

49. A multi-pane window having a magnetic raise/lower mechanism for raising and lowering a venetian blind disposed between the glass panes thereof, the magnetic raise/lower mechanism comprising:

a raise/lower line coupled to the venetian blind;

an inner follower carriage disposed between the glass panes and operable to actuate said raise/lower line thereby to move said venetian blind;

an external carriage disposed outside the glass panes and magnetically coupled to said inner follower carriage, said external carriage being moveable to move said inner follower carriage and actuate the raise/lower line;

an external slider coupled to said external carriage and operable to move said external carriage when said external slider is moved; and a clutch acting between said external carriage and said external slider and operable to decouple said external carriage from said external slider when a force exceeding a threshold level is applied to said external slider to inhibit said external carriage and said inner follower carriage from magnetically decoupling.

50. A multi-pane window according to claim 49, wherein said clutch is mechanical.

51. A multi-pane window according to claim 49, wherein said clutch comprises:

a first magnet secured to said external carriage; and a second magnet secured to said external slider, said second magnet being magnetically coupled to said first magnet by a magnetic force that is less than the magnetic force coupling the external carriage and the inner follower carriage.

52. A multi-pane window according to claim 51, wherein said first magnet and said second magnet magnetically couple when said first magnet and said second magnet abut.

53. A multi-pane window according to claim 51, wherein said clutch further comprises:

a first feature on said external carriage; and a second feature on said external control operable to engage said first feature when said external carriage is positioned adjacent said external control.

54. A multi-pane window having a magnetic mechanism for actuating a venetian blind disposed between glass panes thereof, the magnetic mechanism comprising:

an inner carriage disposed between the glass panes and operable to actuate said venetian blind when moved along the glass panes, said inner carriage including a first support plate having a first plurality of magnetic carriage assemblies arranged thereon;

an external carriage disposed outside the glass panes and including a second support plate having a second plurality of magnetic carriage assemblies arranged thereon such that said external carriage is moveable along said glass panes to move said inner carriage; and a clutch coupled to said external carriage, said clutch decoupling from said external carriage when a force is applied to said clutch that exceeds a threshold level during movement of said external carriage to inhibit said external carriage and said inner carriage from magnetically decoupling, wherein said magnetic mechanism is a raise/lower mechanism coupled to a raise/lower line of said venetian blind.

55. The multi-pane window of claim 54, wherein the first magnetic carriage assemblies are floatingly and magnetically coupled to the first support plate, the second magnetic carriage assemblies are floatingly and magnetically coupled to the second support plate, and the first magnetic carriage assemblies are floatingly coupled with the second magnetic carriage assemblies via one of the glass panes.

* * * * *